US007385134B2

(12) United States Patent
Sawada et al.

(10) Patent No.: US 7,385,134 B2
(45) Date of Patent: Jun. 10, 2008

(54) WIND MUSICAL INSTRUMENT HAVING PADS FOR CLOSING TONE HOLES WITH MECHANICAL ASSISTANCE AND SUPPORTING SYSTEM USED THEREIN

(75) Inventors: Shuichi Sawada, Shizuoka-ken (JP); Hideo Suzuki, Shizuoka-ken (JP); Yoshinori Hayashi, Shizuoka-Ken (JP); Akihiko Komatsu, Shizuoka-Ken (JP); Nariyasu Yaguchi, Shizuoka-Ken (JP); Souichi Takigawa, Shizuoka-ken (JP)

(73) Assignee: Yamaha Corporation (JP)

( * ) Notice: Subject to any disclaimer, the term of this patent is extended or adjusted under 35 U.S.C. 154(b) by 0 days.

(21) Appl. No.: 11/685,845

(22) Filed: Mar. 14, 2007

(65) Prior Publication Data

US 2007/0227343 A1 Oct. 4, 2007

(30) Foreign Application Priority Data

Mar. 31, 2006 (JP) ..... 2006-096572

(51) Int. Cl.
*G10H 3/00* (2006.01)

(52) U.S. Cl. ..... 84/723; 84/330; 84/337; 84/745

(58) Field of Classification Search ..... None
See application file for complete search history.

(56) References Cited

U.S. PATENT DOCUMENTS 4,957,029 A 9/1990 Kahonen
5,668,340 A * 9/1997 Hashizume et al. ..... 84/742
7,112,735 B2 * 9/2006 Shire ..... 84/395
2007/0234887 A1 * 10/2007 Sawada et al. ..... 84/723
2007/0277666 A1 * 12/2007 Laukat et al. ..... 84/382
2008/0017014 A1 * 1/2008 Suzuki ..... 84/385 R

FOREIGN PATENT DOCUMENTS

| | | |
|---|---|---|
| DE | 38 06 396 | 9/1989 |
| GB | 1 004 311 | 9/1965 |
| JP | 06-222752 | 8/1994 |
| JP | 2004-177828 A | 6/2004 |
| NL | 1011954 | 11/2000 |

* cited by examiner

*Primary Examiner*—Marlon T Fletcher
(74) *Attorney, Agent, or Firm*—Dickstein, Shapiro, LLP.

(57) ABSTRACT

A saxophone has a complicated key mechanism for selectively closing and opening tone holes, and fingering on touch buttons and keys is not easy for children, handicapped persons and old players; a supporting system is combined with the saxophone so as to assist a human player in fingering, and includes sensors, actuators and a controlling unit; while the human player is fingering on the touch buttons and keys, the sensors inform the controlling unit of changes of the depressed touch buttons and depressed keys, and the controlling unit supplies driving signals to the actuators associated with the tone holes to be closed so as to permit the human player easily and quickly to play music tunes.

20 Claims, 14 Drawing Sheets

WIND MUSICAL INSTRUMENT HAVING PADS FOR CLOSING TONE HOLES WITH MECHANICAL ASSISTANCE AND SUPPORTING SYSTEM USED THEREIN

FIELD OF THE INVENTION

This invention relates to a wind musical instrument formed with tone holes closed with padded cups/padded keys and, more particularly, to a wind musical instrument performed with assistance of a supporting system and the supporting system combinable with the wind musical instrument.

DESCRIPTION OF THE RELATED ART

A saxophone and a clarinet are typical examples of the wind musical instrument, and are respectively equipped with key mechanisms for closing and opening tone holes formed in the main body of the saxophone and the main body of the clarinet. Players blow into the main bodies through the mouthpieces, and change the pitch of tones by selectively closing and opening the tone holes with the padded cups/padded keys. If the players softly exert force on the padded cups/padded keys, the tone holes are imperfectly closed with the padded cups/padded keys, and the air is leaked through the gaps between the tone hole chimneys and the pads. The leaked air makes the tone unstable, and the players feel the leaked air noisy. The players are to close and open the tone holes in their performances for the clear tones. However, the load on player's fingers is not small. The padded cups/padded keys return to their open positions by means of return springs, and the padded cups/padded keys are swung between the open positions and the closed positions through rotation of key rods. This means that the players depress the keys against the elastic force of the return springs and the friction between the key rods and the key posts. A baritone saxophone has large padded cups/padded cups so that the elastic force of return springs are larger than that of a tenor saxophone. In case where the players perform fast music passages, they quickly change the tone holes between the open state and the closed state, and feel the load, i.e., the elastic force of return springs and the friction between the key rods and the key posts heavy. For this reason, children, handicapped persons and old players feel the wind musical instrument equipped with the key mechanisms not easy to play.

An automatic playing system is disclosed in Japan Patent Application laid-open No. Hei 6-222752. The prior art automatic playing system disclosed in the Japan Patent Application laid-open is incorporated in a keyboard musical instrument. However, an automatic playing system for a wind musical instrument is disclosed in Japan Patent Application laid-open No. 2004-177828. The prior art automatic playing system comprises an air compressor, an air valve, an artificial mouth, valve actuators and a controlling unit. The valve actuators are provided in association with the finger buttons/keys connected to the valves inside the wind instrument. The compressed air is supplied through the air valve to the artificial lips, and the artificial lips give rise to the vibrations of the column of air in the wind instrument. The airflow is controlled by means of the air valve, and the valves are changed between the open state and the closed state by means of the valve actuators. A set of music data codes, which are expressed in accordance with the MIDI (Musical Instrument Digital Interface) protocols, is supplied to the controlling unit. The controlling unit analyzes the music data codes, and energizes the valve actuators at proper timing to change the pitch of tones through the valves of the wind instrument. However, the prior art automatic playing system does not aim at supporting children, handicapped persons and old people. In other words, the wind musical instrument is performed by the automatic playing system instead of a human player, but is not performed by a human player with the assistance of the prior art automatic playing system. Thus, the prior art automatic playing system disclosed in the Japanese Patent Application laid-open does not make it possible to play wind instruments with the fingers of a child, a handicapped person or an old person.

SUMMARY OF THE INVENTION

It is therefore an important object of the present invention to provide a wind musical instrument equipped with a key mechanism, on which a human player fingers so as to close and open tone holes with the assistance of a supporting system.

It is also an important object of the present invention to provide the supporting system which is combined with an acoustic wind musical instrument for assisting a human player in fingering on the key mechanism of the acoustic wind musical instrument.

To accomplish the object, the present invention proposes mechanically to assist a human player in fingering on a key mechanism of a wind musical instrument.

In accordance with one aspect of the present invention, there is provided a wind musical instrument for producing tones through vibrations of air column, and the wind musical instrument comprises an acoustic wind musical instrument including a tubular body formed with tone holes so as to vary length of the air column defined therein and a key mechanism having padded closers responsive to fingering of a human player so as to close and open the tone holes and a supporting system combined with the acoustic wind musical instrument and including sensors producing detecting signals representative of the fingering, actuators provided on the tubular body in association with the padded closers and responsive to driving signals so as to cause the tone holes to be closed with the padded closers and opened and a controlling unit connected to the sensors and the actuators, determining certain tone holes to be closed with the padded closers and opened on the basis of the detecting signals and supplying the driving signals to the actuators associated with the certain tone holes.

In accordance with another aspect of the present invention, there is provided a supporting system combined with an acoustic wind musical instrument having a tubular body formed with tone holes and a key mechanism used for closing and opening the tone holes, and the supporting system comprises sensors producing detecting signals representative of fingering of a human player on the key mechanism, actuators provided on the tubular body in association with padded closers of the key mechanism, and responsive to driving signals so as to cause the tone holes to be closed with the padded closers and opened and a controlling unit connected to the sensors and the actuators, determining certain tone holes to be closed with the padded closers and opened on the basis of the detecting signals and supplying the driving signals to the actuators associated with the certain tone holes.

BRIEF DESCRIPTION OF THE DRAWINGS

The features and advantages of the wind musical instrument and supporting system will be more clearly understood from the following description taken in conjunction with the accompanying drawings, in which.

DESCRIPTION OF THE PREFERRED EMBODIMENTS

A wind musical instrument embodying the present invention produces tones through vibrations of air column. The wind musical instrument comprises an acoustic wind musical instrument and a supporting system. A human player plays music tunes on the acoustic wind musical instrument with or without assistance of the supporting system.

The wind musical instrument includes a tubular body and a key mechanism. The tubular body is formed with tone holes so as to vary length of the air column defined therein, and the key mechanism is provided on the tubular body. The key mechanism has padded closers, which are responsive to the fingering of the human player so as to close and open the tone holes.

The supporting system includes sensors, actuators and a controlling unit, and the sensors and actuators are connected to the controlling unit. The sensors produces detecting signals representative of the fingering, and the actuators are provided on the tubular body in association with the padded closers. The actuators are responsive to driving signals so as to cause the tone holes to be closed with the padded closers and opened. The controlling unit determines certain tone holes to be closed with the padded closers and opened on the basis of the detecting signals, and supplies the driving signals to the actuators associated with the certain tone holes.

Even if the human player is a child, a handicapped person or an old player, the human player needs to exert force to make the sensors to change the detecting signals to an active level. The actuators exert force on the padded closers together with the player so that the human player feels the key mechanism light enough to quickly finger a fast music passage on the key mechanism. Thus, the supporting system assists the human player in fingering music tunes on the key mechanism.

First Embodiment

Figure 1:
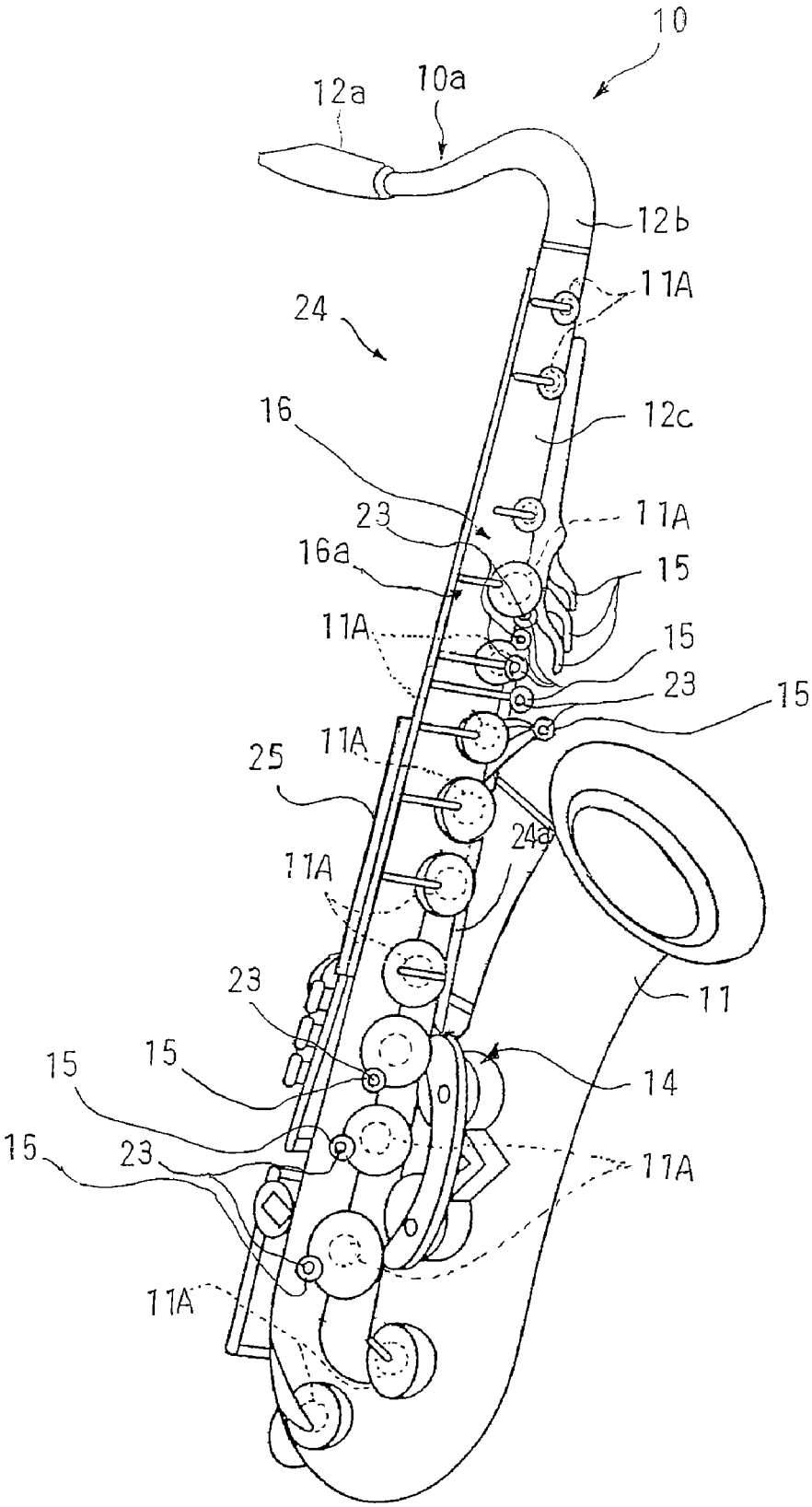
FIG. 1 is a schematic perspective view showing a wind musical instrument of the present invention.
Figure 2:
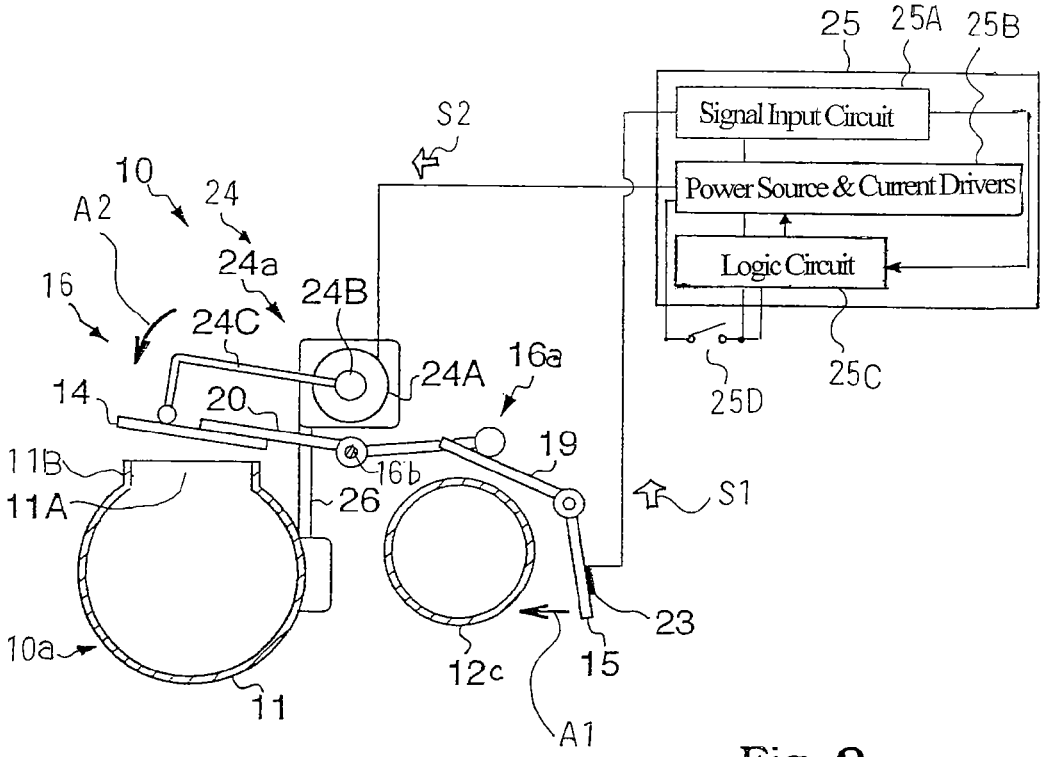
FIG. 2 is a schematic cross sectional view showing the structure of a tubular body and a key mechanism incorporated in the wind musical instrument.

Referring first to FIGS. 1 and 2 of the drawings, a wind musical instrument embodying the present invention largely comprises a saxophone 10 and a supporting system 24. A human player plays music tunes on the saxophone 10 with and without assistance of the supporting system 24. While the human player is performing a music tune on the saxophone 10 without any assistance of the supporting system 24, he or she blows into the saxophone 10 so as to give rise to vibrations of a column of air, and changes the pitch of tones through fingering for varying the length of the column of air. The human player exerts force on the saxophone 10 for varying the length of the column of air by himself or herself, and the supporting system 10 does not assist the human player in varying the length of the column of air.

On the other hand, while the human player is performing a music tune on the saxophone 10 with the assistance of the supporting system 24, he or she also blows into the saxophone, and changes the pitch of tones through the fingering. When the human player changes the pitch of a tone, not only the human player but also the supporting system 24 exert the force on the saxophone 10 for varying the length of the column of air. For this reason, the human player feels load on his or her fingers light.

The saxophone 10 is broken down into a tubular body 10*a* and a key mechanism 16. The tubular body 10*a* includes an upturned flared bell 11, a mouthpiece 12*a*, a neck 12*b* and a conical metal tube 12*c*, and is formed with tone holes 11A. The tone holes 11A are not equal in diameter, but have appropriate values of diameter to produce tones at predetermined pitch. Tone hole chimneys 11B project from the outer surface of the tubular body 10*a*, and define the peripheries of the tone holes 11A. A column of air is defined in the tubular body 10*a*, and is vibratory for producing tones.

Though not shown in the drawings, a reed is fitted to the mouthpiece 12*a*, and the neck 12*b* is connected to the mouthpiece 12*a*. The conical metal tube 12*c* is connected at one end thereof to the neck 12*b*, and has the upturned flared bell 11 at the other end thereof. A player holds the mouthpiece 12*a* in his or her mouth, and blows into the mouthpiece 12*a*. Then, the column of air vibrates for producing tones.

The key mechanism 24 is fitted to the tubular body 10*a*, and includes padded cups/padded keys 14, touch buttons/keys 15 to be depressed by a human player and a link work 16*a*. The padded cups/padded keys 14 and other keys are provided in association with the tone holes 11A, and are wider than the associated tone holes 11A are. The link work 16*a* has link sub-works 19, which are connected to the touch buttons/keys 15, other link sub-works 20, which are connected to the padded cups 14/padded keys, and return springs (not shown). The link sub-works 19 and 20 are rotatable about axes of shafts 16*b*, and the link sub-works 19 are partially held in contact with each other. The return springs (not shown) always urge the link work 16*a* in a direction to space the padded cups/padded keys 14 from the tone hole chimneys 11B.

Figure 3:
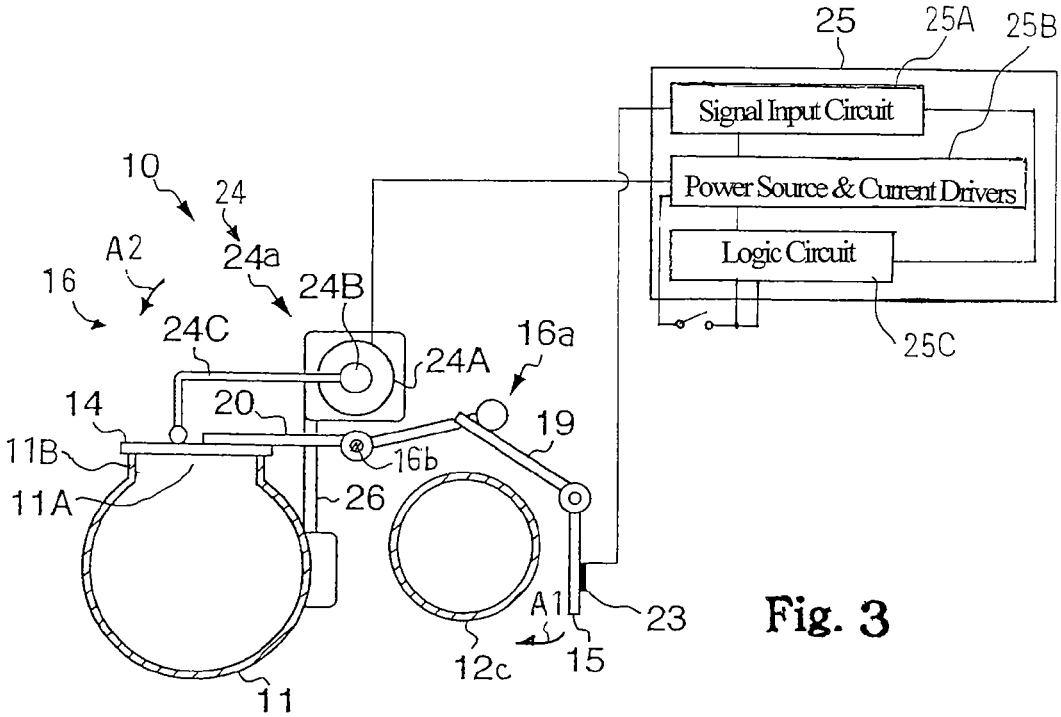
FIG. 3 is a schematic view showing a tone hole closed with a padded cup/padded key of the key mechanism.

When a player depresses the touch button/key 15 in a direction indicated by arrow A1 against the elastic force of the return spring (not shown), the link sub-work 19 causes the link sub-work 20 to rotate in a direction indicated by arrow A2, and makes the link sub-work 20 close the tone hole 11A with the padded cup/padded key 14 as shown in FIG. 3. On the other hand, when the player releases the touch button/key 15, the return spring (not shown) gives rise to rotation of the link sub-work 20 in the direction opposite to the arrow A2, and causes the link sub-work 19 to rotate in the direction opposite to the arrow A1. As a result, the tone hole 11A is opened, and the touch button/key 15 returns to the rest position as shown in FIG. 2.

The supporting system 24 includes pressure-sensitive pads 23, actuators 24*a* and a controlling unit 25. The pressure-sensitive pads 23 are adhered to the touch buttons/keys 15 and other keys depressed by the thumbs and fingers of a human player, and are connected to the controlling unit 25. The actuators 24*a* are provided in association with the link sub-works 20, and are also connected to the controlling unit 25.

Figure 4A:
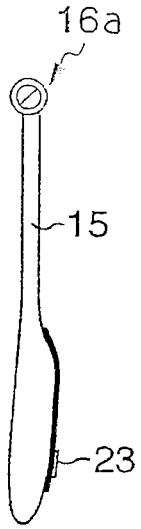
FIG. 4A is a side view showing a pressure-sensitive pad adhered to a key.
Figure 4B:
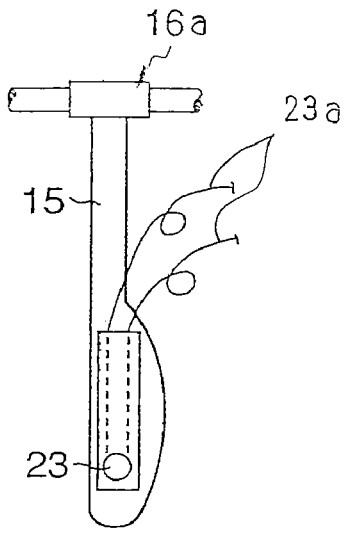
FIG. 4B is a front view showing the pressure-sensitive pad and key.

Each of the pressure-sensitive pads 23 has an inner pressure-sensitive sheet and an outer protective sheet. The pressure-sensitive pads 23 are adhered to the outer surfaces, which are reverse to the inner surfaces opposed to the conical metal tube 12*c*, of the touch buttons/keys 15, and lead lines 23*a* are connected between the pressure-sensitive pads 23 and the controlling unit 25 as shown in FIGS. 4A and 4B.

When a player exerts the force on the protective sheet, the force makes the pressure-sensitive sheet deformed, and the pressure-sensitive sheet varies the resistance against electric current. Thus, the pressure-sensitive pads 23 produces detecting signals S1 representative of the fingering of the player, and supply the detecting signals S1 to the controlling unit 25.

The actuators 24*a* are supported by the upturned flared bell 11 through stays 26. The stays 26 are adhered to the upturned flared bell 11 as shown in FIGS. 2 and 3. Each of the actuators 24*a* includes an ultrasonic motor 24A with an output shaft 24B and an arm 24C. The ultrasonic motor 24A is energized with a driving signal S2, which is supplied from the controlling unit 25, and rotates the output shaft 24B in one of the clockwise direction and counter clockwise direction in FIGS. 2 and 3 depending upon the driving signal S2. When the driving signal S2 is removed from the ultrasonic motor 24A, the output shaft 25B is prohibited from further rotation. The arm 24C is secured at one end thereof to the output shaft 24B, and the return spring (not shown) keeps the associated padded cup/padded key 14 held in contact with the other end of the arm 24C.

The ultrasonic motor 24A is assumed to give rise to the rotation of output shaft 24B in the counter clockwise direction in FIG. 2. The arm 24C presses the padded cup/padded key 14 toward the tone hole chimney 11B, and causes the tone hole 11A to be closed with the padded cup/padded key 14. The rotation of the link sub-work 20 in the direction indicated by arrow A2 gives rise to the rotation of link sub-work 19 in the direction indicated by arrow A1.

On the other hand, when the ultrasonic motor 24A rotates the output shaft 24B in the clockwise direction in FIG. 3, the arm 24C rotates in the direction opposite to the direction indicated by arrow A2, and the return spring (not shown) causes the padded cup/padded key 14 to leave the tone hole chimney 11B. The rotation of link sub-work 20 in the direction opposite to the direction indicated by arrow A2 gives rise to the rotation of link sub-work 19 in the direction opposite to the direction indicated by arrow A1.

The controlling unit 25 includes a signal input circuit 25A, a power source and current driving circuit 25B, a logic circuit 25C and a switch board 25D. The signal input circuit 25A is connected to the logic circuit 25C, and the logic circuit 25C is connected to the current driving circuits in the power source and current driving circuit 25B. The power source in the power source and current driving circuit 25B is connected through the switch board 25D to the logic circuit 25C and signal input circuit 25A. A power supply switch is provided on the switch board 25D, and the electric power is supplied from the power source in the power source and current driving circuit 25B through the power supply switch to the logic circuit 25C and signal input circuit 25A. In this instance, the electric power is implemented by a battery, and the controlling unit 25 is fitted to the conical metal tube 12*c*.

All of the detecting signals S1 are input in parallel to the signal input circuit 25A, and are subjected to amplification and waveform shaping in the signal input circuit 25A. After the amplification and waveform shaping, the detecting signals S1 are supplied to the logic circuit 25C. The combinations of detecting signals S1 at an active level are indicative of the tone holes 11A to be closed with the padded cups/padded keys 14. The logic circuit 25C determines the actuators 24A to be energized on the basis of the combination of detecting signals S1, and supplies control signals indicative of the actuators 24*a* to be energized to the current driving circuits in the power source and current driving circuits 25B.

The current driving circuits in the power source and current driving circuits 25B are responsive to the control signals so as to supply the driving signals S2 to the actuators associated with the padded cups/padded keys 14 over the tone holes 11A to be closed.

A human player is assumed to be playing a music tune on the wind musical instrument with the assistance of the supporting system 24. The power supply switch is turned on, and the electric power is supplied to the logic circuit 25C, the signal input circuit 25A and the current driving circuits in the power source and current driving circuits 25B.

Figure 5:
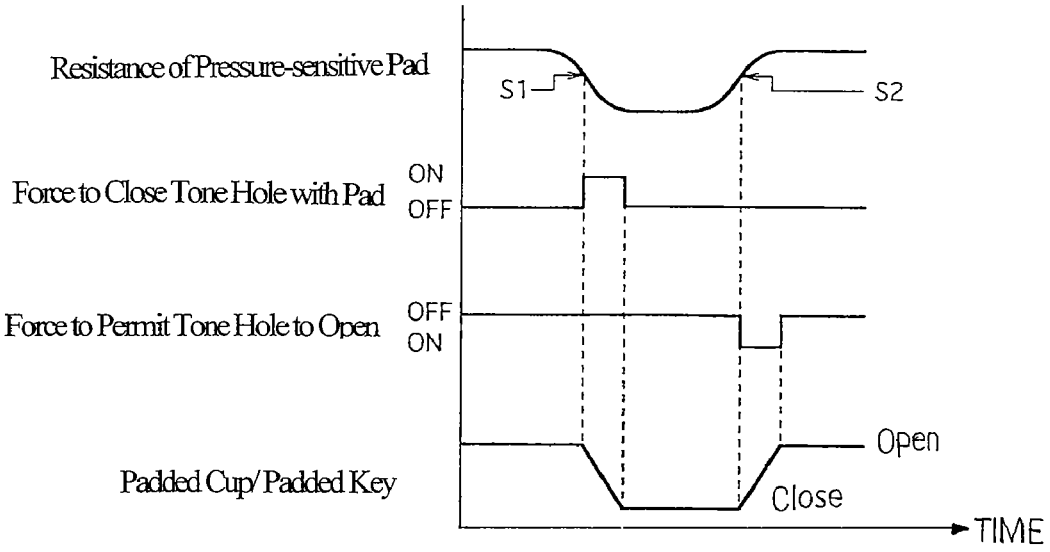
FIG. 5 is a timing chart showing behavior of a supporting system.

He or she blows into the mouthpiece 12*a*, and selectively closes and opens the tone holes 11A through the key mechanism 16*a* so as to change the pitch of tones. The human player is assumed to depress the key 15 shown in FIG. 2. The pressure-sensitive pad 23 reduces the resistance thereof, and raises the potential level of the detecting signal S1. When the resistance is reduced below a threshold S1 as shown in FIG. 5, the detecting signal S1 is changed active, and the detecting signals S1 at the signal input circuit 25A are changed from the previous combination to another combination. Then, the logic circuit 25C determines the tone holes 11B to be closed on the basis of the new combination. The tone hole 11B shown in FIG. 2 is to be closed with the padded cup 14.

The logic circuit 25C changes the control signal indicative of the actuator 24*a* shown in FIG. 2 to the active level. Then, the current driving circuits in the power source and current driving circuits 25B respond to the control signals, and changes the driving signal S2 to be supplied to the actuator 24*a* shown in FIG. 2 to the active level. With the driving signal S2, the ultrasonic motor 24A drives the output shaft 24B for the rotation in the counter clockwise direction, and causes the link sub-work 20 to rotate in the direction indicated by arrow A2 against the elastic force of the return spring (not shown).

The link sub-work 20 exerts the force on the padded cup 14 as indicated by change from "OFF" to "ON" in FIG. 5, and makes the tone hole 11A closed with the padded cup 14 as shown in FIG. 3. When the padded cup 14 is brought into contact with the tone hole chimney 11B, the driving signal S2 is changed to the inactive level, and the force is removed from the padded cup 14. Since the ultrasonic motor 24A restricts the output shaft 24B from the rotation in the clockwise direction, the ultrasonic motor 24A keeps the tone hole 11A closed in so far as the human player continuously depresses the pressure-sensitive pad 23. As a result, the tone is produced at the pitch desired by the human player.

When the human player wishes to recover the tone to the previous pitch, he or she leaves the finger from the pressure sensitive pad 23. The resistance of the pressure-sensitive pad 23 is raised, and exceeds a threshold S2. Then, the detecting signal S1 changes the potential level to the inactive level, and the logic circuit 25C notices the change to the previous combination. The control signal indicative of the actuator 24*a* is changed from the active level to the inactive level, and the associated current driver in the power source and current driver circuits 25B changes the driving signal S2 to the other active level indicative of the rotation in the opposite direction as shown in FIG. 5.

The ultrasonic motor 24A rotates the output shaft 24B in the clockwise direction in FIG. 3, and causes the link sub-work 20 to rotate in the direction opposite to the direction indicative by arrow A2. When the padded cup 14 reaches the rest position, the driving signal S2 is recovered to the inactive level as shown in FIG. 5, and the ultrasonic motor 24A keeps the output shaft 24B and link sub-work 20 from further rotation. As a result, the wind musical instrument produces the tone at the previous pitch.

If the human player does not wish the assistance of the supporting system 24, he or she turns off the power supply switch, and performs the saxophone 10 as similar to a tenor standard saxophone.

As will be understood from the foregoing description, the controlling unit 25 causes the actuators 24*a* selectively to energize in response to the detecting signals S1 indicative of the fingering of a human player. By virtue of the supporting system 24, the human player can change the pitch of tones by lightly depressing the pressure sensitive pads 23. The supporting system 24 according to the present invention permits a child, a handicapped person and an old player to enjoy their performances on the wind musical instrument of the present invention. Although the supporting system 24 can not perform any music tune on the saxophone, the child, handicapped person and old player appreciate the assistance of the supporting system 24 in their performances.

Description is hereinafter made on other embodiments of the present invention. The second embodiment to seventh embodiment include other sorts of detectors or sensors instead of the pressure-sensitive pads 23, and the eighth embodiment to twelfth embodiment include other sorts of actuators instead of the ultrasonic motors 24A.

Second Embodiment

Figure 6A:
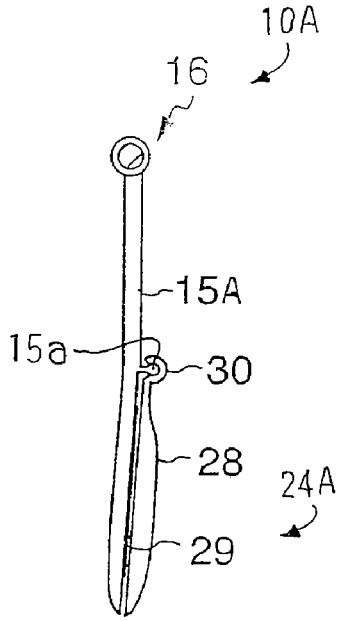
FIG. 6A is a side view showing a pressure-sensitive pad sandwiched between a key and a pusher incorporated in another wind musical instrument according to the present invention.
Figure 6B:
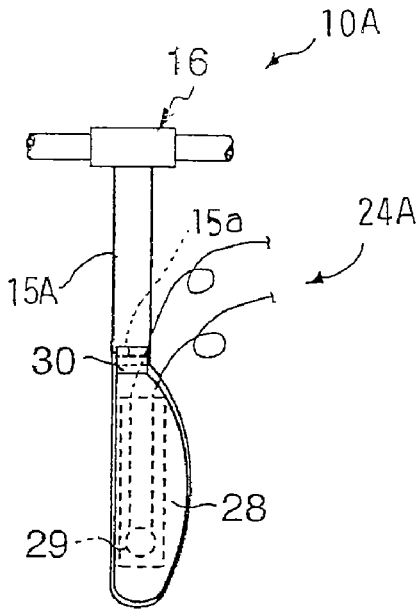
FIG. 6B is a front view showing the pressure-sensitive pad, pusher and key.

Turning to FIGS. 6A and 6B of the drawings, another wind musical instrument embodying the present invention also largely comprises an acoustic wind musical instrument 10A such as a saxophone and a supporting system 24A. The acoustic wind musical instrument 10A is similar to the saxophone 10 except for touch buttons/keys 15A, and other component parts of acoustic wind musical instrument 10A are labeled with references designating the corresponding component parts of saxophone 10 without detailed description for the sake of simplicity. Each of the touch buttons/keys 15A is formed with a small projection 15*a*, and the small projection 15*a* has a rounded head portion. The small projection 15*a* will be hereinafter described in detail in conjunction with a sensor incorporated in the supporting system 24A.

The supporting system 24A is similar to the supporting system 24 except for sensors. For this reason, description is focused on the sensors, and no further description on the other system components is hereinafter incorporated for avoiding repetition.

Each of the sensors is provided in association with one of the touch buttons/keys 15A, and is implemented by a combination of a pusher 28 and a pressure-sensitive sheet 29. The pusher 28 has an outline analogous to the outline of the leading end portion of the key 15A, and is formed with a pocket. The rounded head portion of the small projection is received in the pocket of the pusher 28, and the pocket portion and rounded head portion form in combination a hinge. For this reason, the pusher 28 is rotated about the rounded head portion of small projection 15*a*.

The pressure-sensitive sheet 29 is adhered to the leading end portion of the key 15A so as to be found between the leading end portion of key 15A and the pusher 28. When a player rotates the pusher 28 toward the key 15A, the pusher 28 is brought into contact with the entire surface of the pressure-sensitive sheet 29, and uniformly exerts force on the entire surface.

The wind musical instrument implementing the second embodiment achieves all the advantages of the first embodiment. Moreover, even if a human player concentrates the force on a small area of the pusher 28, the entire surface of the pressure-sensitive sheet 29 is uniformly pressed with the pusher 28, and the resistance of pressure sensitive sheet 29 is varied regardless of the area on which the force is exerted.

Third Embodiment

Figure 7A:
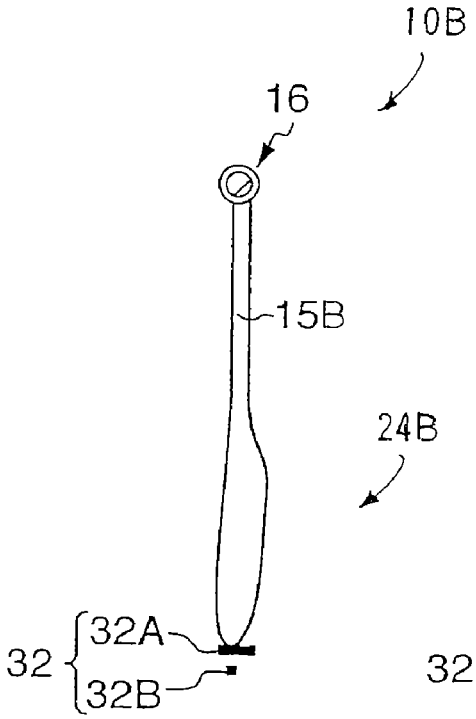
FIG. 7A is a side view showing a key sensor incorporated in yet another wind musical instrument according to the present invention.
Figure 7B:
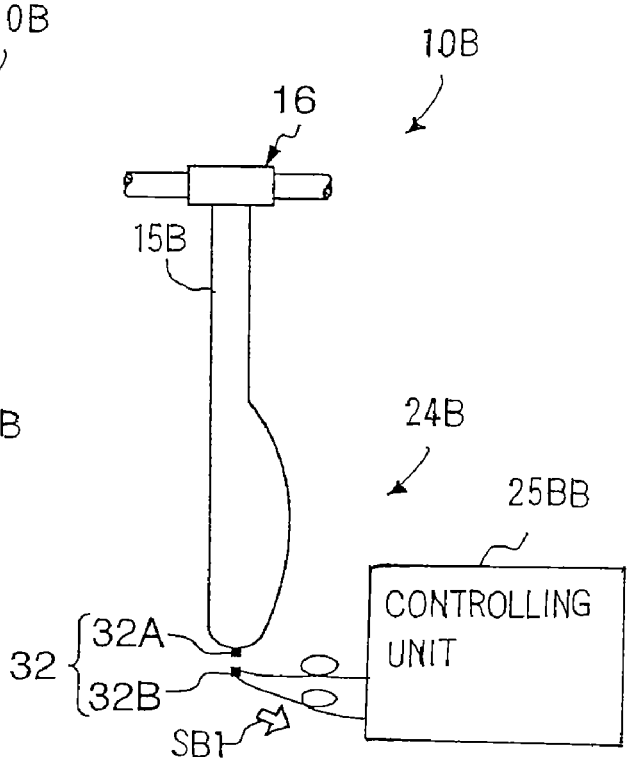
FIG. 7B is a front view showing the key sensor and key.

Turning to FIGS. 7A and 7B of the drawings, yet another wind musical instrument embodying the present invention also largely comprises an acoustic wind musical instrument 10B and a supporting system 24B. The acoustic wind musical instrument 10B is similar to the saxophone 10, and component parts of acoustic wind musical instrument 10B are labeled with references designating the corresponding component parts of saxophone 10 without detailed description for the sake of simplicity.

The supporting system 24B is similar to the supporting system 24 except for sensors and a controlling unit 25BB. For this reason, description is focused on the sensors and controlling unit 25BB, and no further description on the other system components is hereinafter incorporated for avoiding repetition.

Each of the sensors is provided in association with one of the touch buttons/keys 15B, and is implemented by a combination of a magnetic scale 32A and a magnetic sensor head 32B. The magnetic scale 32A is adhered to the leading end portion of the key 15B of the wind musical instrument, and is movable together with the key 151B. On the other hand, the magnetic sensor head 32B is opposed to the magnetic scale 32A, and is stationary with respect to the tubular body 10*a*. In this instance, the magnetic sensor heads 32B are supported by the tubular body 10*a*. Pieces of positional data are magnetically written on the magnetic scale 32A, and the magnetic sensor head 32B converts the pieces of positional data to pulse trains expressing digital codes or a detecting signal SB1. Thus, the magnetic sensor head 32B is operative to encode the pieces of positional data on the magnetic scale 32A.

The controlling unit 25BB has a data processing capability, and periodically fetches the pieces of positional data. The pieces of positional data are accumulated in a memory in the controlling unit 25BB, and are analyzed to see whether or not the key 15B is moved and which direction the key 15B is moved. The controlling unit 25BB prepares the driving signals on the basis of the analysis, and supplies the driving signals to the actuators.

The supporting system 24B also achieves all the advantages of the first embodiment. Moreover, the controlling unit 25BB can determine the movements of the keys 15B more precisely through the data processing capability so that the actuators are controlled more exactly.

Fourth Embodiment

Figure 8A:
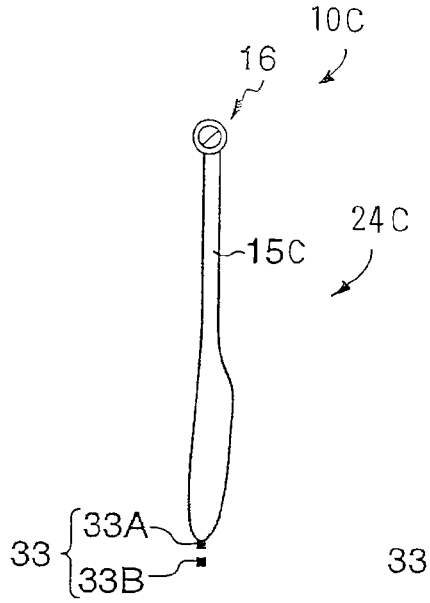
FIG. 8A is a side view showing a key sensor incorporated in still another wind musical instrument according to the present invention.
Figure 8B:
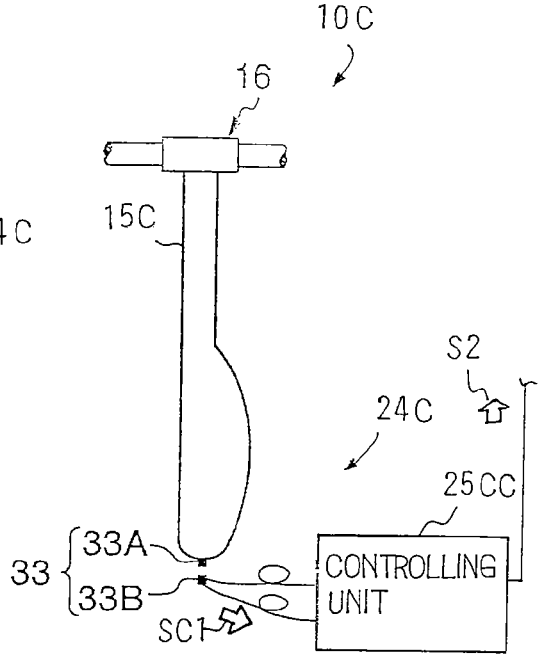
FIG. 8B is a front view showing the key sensor and key.

Turning to FIGS. 8A and 8B of the drawings, still another wind musical instrument embodying the present invention also largely comprises an acoustic wind musical instrument 10C and a supporting system 24C. The acoustic wind musical instrument 10C is similar to the saxophone 10, and component parts of acoustic wind musical instrument 10C are labeled with references designating the corresponding component parts of saxophone 10 without detailed description for the sake of simplicity.

The supporting system 24C is similar to the supporting system 24 except for key sensors and a controlling unit 25CC. For this reason, description is focused on the key sensors and controlling unit 25CC, and no further description on the other system components is hereinafter incorporated for avoiding repetition.

Each of the key sensors is provided in association with one of the touch buttons/keys 15C, and is implemented by a combination of a piece of permanent magnet 33A and an electromagnetic pickup 33B. The piece of permanent magnet 33A is adhered to the leading end of the key 15C, and is movable together with the key 15C. On the other hand, the electromagnetic pickup 33B is stationary with respect to the tubular body 10*a* so that the electromagnetic pickup 33B converts the velocity of piece of permanent magnet 33A to a detecting signal SC2 representative of the current value of the velocity.

The controlling unit 25CC has a data processing capability as similar to the controlling unit 25BB, and periodically fetches the pieces of velocity data represented by the detecting signal SC1. The pieces of velocity data are accumulated in a memory in the controlling unit 25CC, and are analyzed to see whether or not the key 15C is moved and how far the key 15C is moved from the rest position. The stroke of the key 15C is determined through the integration on the pieces of velocity data. When the key stroke is equal to the distance between the rest position and the tone hole chimney 11B, the controlling unit 25CC stops the electric power, and changes a flag indicative of the direction of key movement. The controlling unit 25CC prepares the driving signals S2 on the basis of the analysis, and supplies the driving signals S2 to the actuators.

The supporting system 24C also achieves all the advantages of the first embodiment. Moreover, the controlling unit 25CC can determine the movements of the buttons/keys 15C more precisely through the data processing capability so that the actuators are controlled more exactly.

Fifth Embodiment

Figure 9A:
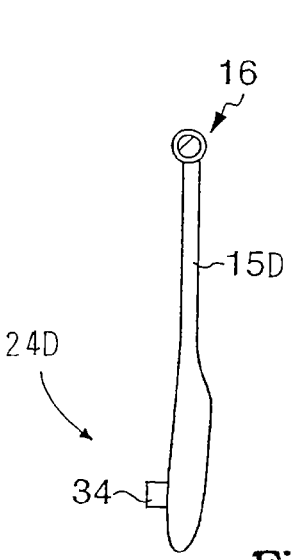
FIG. 9A is a side view showing a key sensor incorporated in yet another wind musical instrument according to the present invention.
Figure 9B:
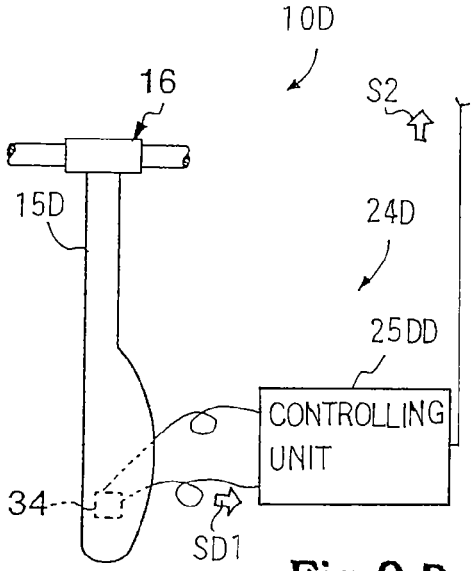
FIG. 9B is a front view showing the key sensor and key.

Turning to FIGS. 9A and 9B of the drawings, yet another wind musical instrument embodying the present invention also largely comprises an acoustic wind musical instrument 10D and a supporting system 24D. The acoustic wind musical instrument 10D is similar to the saxophone 10, and component parts of acoustic wind musical instrument 10D are labeled with references designating the corresponding component parts of saxophone 10 without detailed description for the sake of simplicity.

The supporting system 24D is similar to the supporting system 24 except for key sensors and a controlling unit 25DD. For this reason, description is focused on the key sensors and controlling unit 25DD, and no further description on the other system components is hereinafter incorporated for avoiding repetition.

Each of the key sensors is provided in association with one of the touch buttons/keys 15D, and is implemented by an acceleration sensor 34. In this instance, a tri-axis piezoelectric acceleration sensor is used as the acceleration sensor 34, and the acceleration is detected as the force exerted on the piezoelectric elements. The detecting signal SD1, which is representative of the acceleration, is supplied from each of the acceleration sensor 34 to the controlling unit 25DD.

The controlling unit 25DD has a data processing capability. The pieces of acceleration data, which are carried on the detecting signal SD1, are accumulated in an internal memory of the controlling unit 25DD, and the controlling unit 25DD determines the key position and button position through the integration on the pieces of acceleration data. A flag is indicative of the direction of the acceleration, and an internal register is assigned to the flag. The controlling unit 25DD prepares the driving signal S2 on the basis of the direction of button movement/key movement, and supplies the driving signal S2 to the actuator 24*a*.

The supporting system 24D also achieves all the advantages of the first embodiment. Moreover, the controlling unit 25DD can determine the movements of the buttons/keys 15D more precisely through the data processing so that the actuators are controlled more exactly.

Sixth Embodiment

Figure 10A:
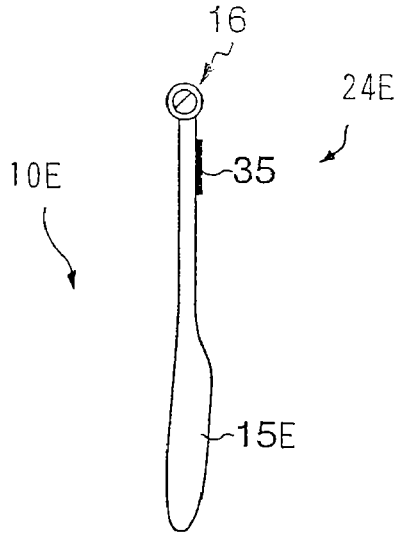
FIG. 10A is a side view showing a key sensor incorporated in still another wind musical instrument according to the present invention.
Figure 10B:
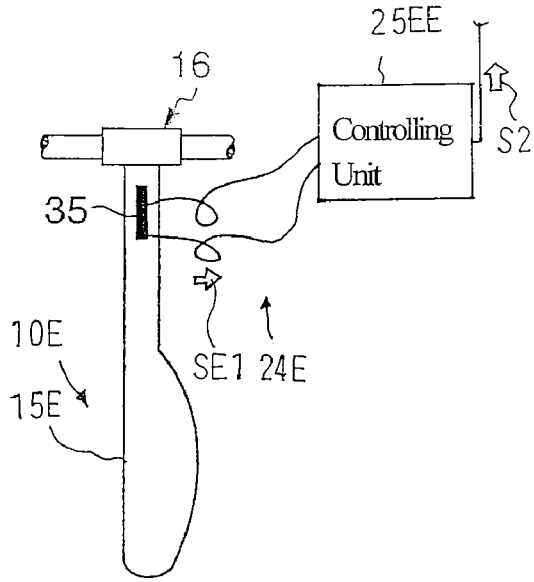
FIG. 10B is a front view showing the key sensor and key.

Turning to FIGS. 10A and 10B of the drawings, still another wind musical instrument embodying the present invention also largely comprises an acoustic wind musical instrument 10E and a supporting system 24E. The acoustic wind musical instrument 10E is similar to the saxophone 10, and component parts of acoustic wind musical instrument 10E are labeled with references designating the corresponding component parts of saxophone 10 without detailed description for the sake of simplicity.

The supporting system 24E is similar to the supporting system 24 except for key sensors and a controlling unit 25EE. For this reason, description is focused on the key sensors and controlling unit 25EE, and no further description on the other system components is hereinafter incorporated for avoiding repetition.

Each of the key sensors is provided in association with one of the touch buttons/keys 15E, and is implemented by a strain sensor 35. In this instance, a strain gage is used as the strain sensor 35, and is adhered to the boss portion of the touch button/key 15E. The detecting signal SE1, which is representative of the strain in the boss portion, is supplied from each of the strain sensor 35 to the controlling unit 25EE.

The controlling unit 25EE has a data processing capability. Pieces of strain data, which are carried on the detecting signal SE1, are accumulated in an internal memory of the controlling unit 25EE, and the strain is detected as the force exerted on the boss portion. The controlling unit 25EE determines the key movement/button movement on the basis of the variation of strain. A flag is indicative of the direction of the deformation, and an internal register is assigned to the flag. The controlling unit 25EE prepares the driving signal S2 through the analysis, and supplies the driving signal S2 to the actuator 24*a*.

The supporting system 24E also achieves all the advantages of the first embodiment. Moreover, the controlling unit 25EE can determine the movements of the buttons/keys 15E more precisely through the data processing so that the actuators 24*a* are controlled more exactly.

Seventh Embodiment

Figure 11A:
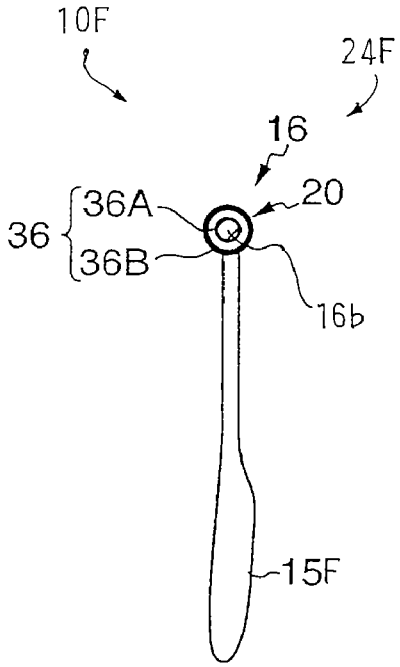
FIG. 11A is a side view showing a key sensor incorporated in yet another wind musical instrument according to the present invention.
Figure 11B:
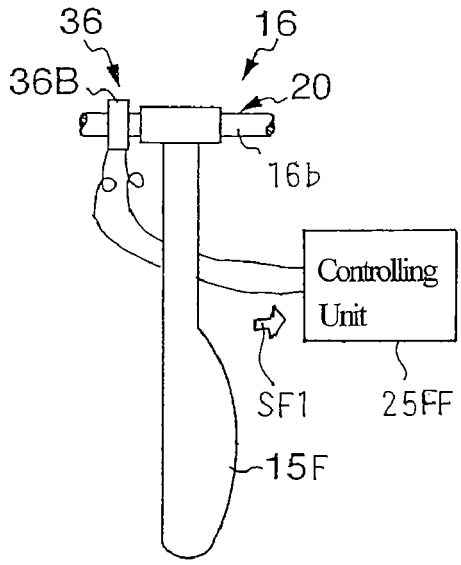
FIG. 11B is a front view showing the key sensor and key.

Turning to FIGS. 11A and 11B of the drawings, yet another wind musical instrument embodying the present invention also largely comprises an acoustic wind musical instrument 10F and a supporting system 24F. The acoustic wind musical instrument 10F is similar to the saxophone 10, and component parts of acoustic wind musical instrument 10F are labeled with references designating the corresponding component parts of saxophone 10 without detailed description for the sake of simplicity.

The supporting system 24F is similar to the supporting system 24 except for key sensors 36 and a controlling unit 25FF. For this reason, description is focused on the key sensors 36 and controlling unit 25FF, and no further description on the other system components is hereinafter incorporated for avoiding repetition.

Each of the key sensors 36 is provided in association with one of the touch buttons/keys 15F, and is implemented by a combination of a magnetostriction element 36A and a coil 36B. The magnetostriction element 36A is fitted to the shaft 16*b* between the link sub-work 19 and the link sub-work 20, and is surrounded by the coil 36B.

The detecting signal SE1, which is representative of the torque exerted on the shaft 16*a*, is supplied from each of the magnetostriction element 35 to the controlling unit 25FF.

The controlling unit 25FF has a data processing capability. Pieces of torque data, which are carried on the detecting signal SF1, are accumulated in an internal memory of the controlling unit 25FF, and are analyzed by the controlling unit 25FF. The controlling unit 25FF determines the key movement/button movement on the basis of the variation of torque. A flag is indicative of the direction of the rotation of shaft 16*b*, and an internal register is assigned to the flag. The controlling unit 25FF prepares the driving signal S2 through the analysis, and supplies the driving signal S2 to the actuator 24*a*.

The supporting system 24F also achieves all the advantages of the first embodiment. Moreover, the controlling unit 25FF can determine the movements of the buttons/keys 15F more precisely through the data processing so that the actuators 24*a* are controlled more exactly.

Eighth Embodiment

Figure 12A:
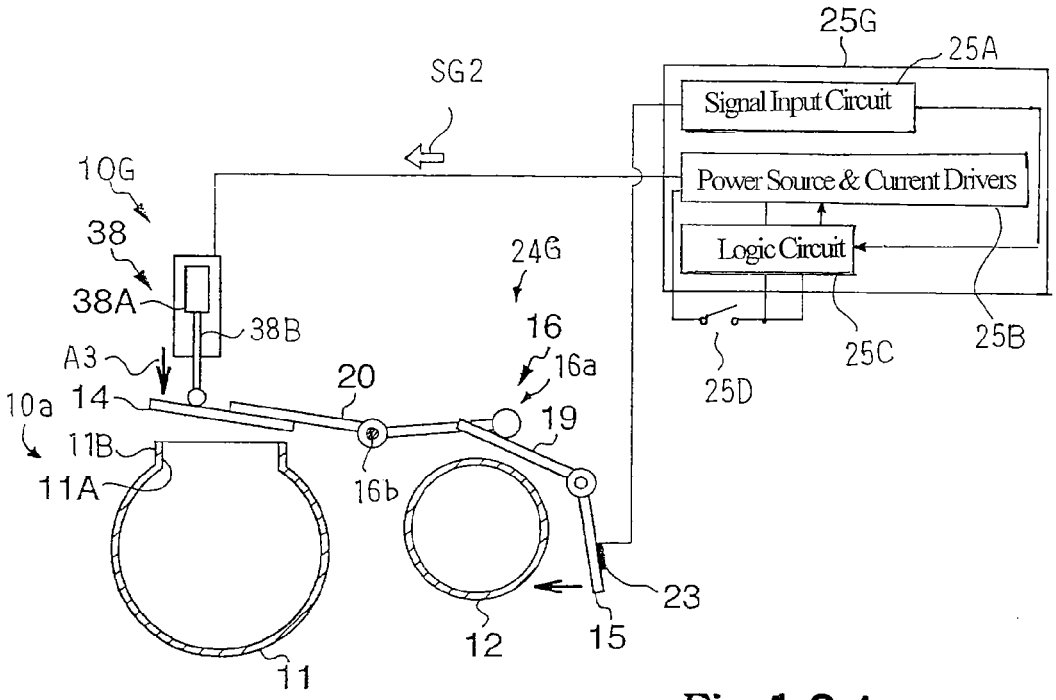
FIG. 12A is a schematic cross sectional view showing the structure of a key mechanism and an actuator incorporated in still another wind musical instrument.
Figure 12B:
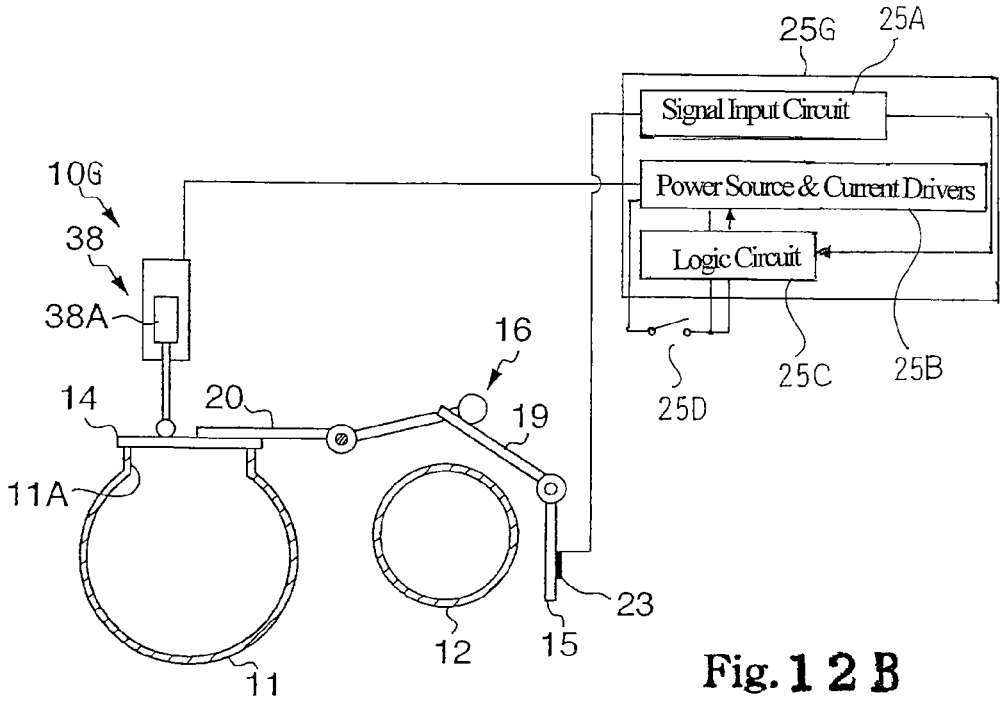
FIG. 12B is a schematic view showing a tone hole closed with a padded cup/padded key of the key mechanism.

Turning to FIGS. 12A and 12B of the drawings, still another wind musical instrument embodying the present invention also largely comprises an acoustic wind musical instrument 10G and a supporting system 24G. The acoustic wind musical instrument 10G is similar to the saxophone 10, and component parts of acoustic wind musical instrument 10G are labeled with references designating the corresponding component parts of saxophone 10 without detailed description for the sake of simplicity.

The supporting system 24G is similar to the supporting system 24 except for actuators. For this reason, description is focused on the actuators, and no further description on the other system components is hereinafter incorporated for avoiding repetition.

Each of the actuators is provided in association with one of the touch buttons/keys 15, and is implemented by a solenoid-operated actuator 38. The solenoid-operated key actuator includes a solenoid 38A and a plunger 38B. The solenoid 38A is supported by the tubular body 10*a*, and is electrically connected to the power source and current drivers 25B. While the solenoid 38A is being energized with a driving signal SG2, magnetic field is created around the plunger 38B, and the plunger 38B projects from the solenoid 38A as indicated by arrow A3. The link sub-system 20 is rotated against the elastic force of the return spring (not shown), which is provided in association with the shaft 16*b*, and the padded cup/padded key 14 is brought into contact with the tone hole chimney 11B. As a result, the tone hole 11A is closed with the padded cup/padded key 14 as shown in FIG. 12B.

On the other hand, when the driving signal SG2 is removed from the solenoid 38A, the return spring (not shown), rotates the link sub-system 20 in the direction opposite to the arrow A3, and causes the plunger 38B to re retracted into the solenoid 38A. Thus, the actuator 38 permits the tone hole 11A to be opened as shown in FIG. 12A.

The supporting system 24G achieves all the advantages of the supporting system 24.

Ninth Embodiment

Figure 13A:
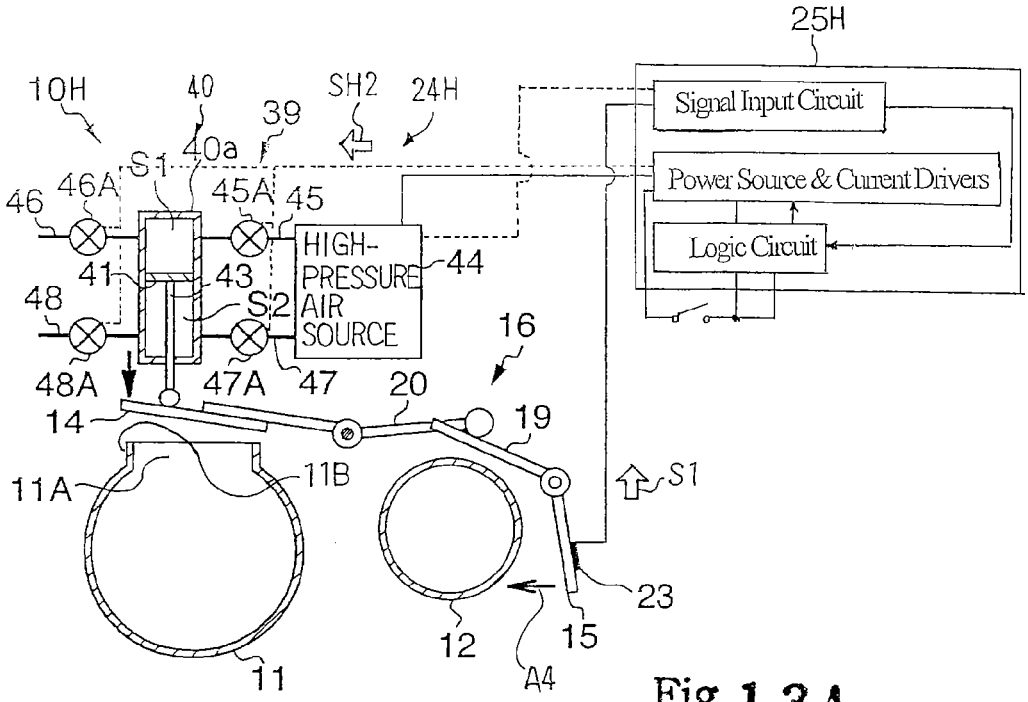
FIG. 13A is a schematic cross sectional view showing the structure of a key mechanism and an actuator incorporated in yet another wind musical instrument.
Figure 13B:
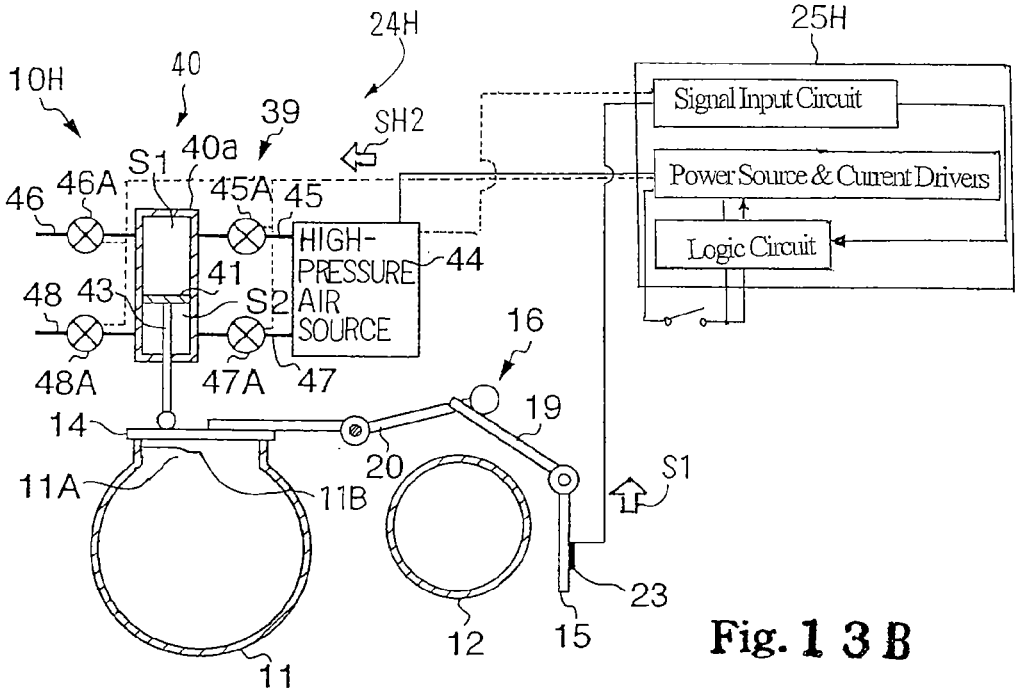
FIG. 13B is a schematic view showing a tone hole closed with a padded cup/padded key of the key mechanism.

Turning to FIGS. 13A and 13B of the drawings, yet another wind musical instrument embodying the present invention also largely comprises an acoustic wind musical instrument 10H and a supporting system 24H. The acoustic wind musical instrument 10H is similar to the saxophone 10, and component parts of acoustic wind musical instrument 10H are labeled with references designating the corresponding component parts of saxophone 10 without detailed description for the sake of simplicity.

The supporting system 24H is similar to the supporting system 24 except for an actuator system 39 and a controlling unit 25H. For this reason, description is focused on the actuator system 39 and controlling unit 25H, and no further description on the other system components is hereinafter incorporated for avoiding repetition.

The actuator system 39 includes pneumatic actuators 40, a high-pressure air source 44, high-pressure air pipes 45/47, exhaust pipes 46/48 and electromagnetic valves 45A/46A/47A/48A. The high-pressure air source 44 is implemented by an air pump, an electric motor, a reservoir tank and a pressure control system. The air pump boosts the air, and the high-pressure air is accumulated in the reservoir tank. The pressure control system monitors the air pressure in the reservoir tank. When the air pressure exceeds an upper limit of a control range, the controlling unit 25H stops the electric power from the air pump. On the other hand, when the air pressure is decayed below a lower limit of the control range, the controlling unit 25H energizes the electric motor, and the electric motor drives the air pump for rotation so as to boost the air in the reservoir tank. Thus, the high-pressure air source 44 is always ready to supply the high-pressure air to destinations.

The high-pressure air source 44 is connected through the high-pressure air pipes 45 to chambers S1 of the pneumatic actuators 40 and through the high-pressure air pipes 47 to chambers S2 of the pneumatic actuators 40. The electromagnetic actuators 45A and 47A are provided in the air passages of the high-pressure air pipes 45/47, and are controlled by the controlling unit 25H. The exhaust pipes 46 are connected to the chambers S1, and the exhaust pipes 48 are connected to the chambers S2. The electromagnetic valves 46A and 48A are provided in the air passages in the exhaust pipes 46/48, and the electromagnetic valves 46A/48A are controlled by the controlling unit 25H.

Each of the pneumatic actuators 40 is provided in association with one of the touch buttons/keys 15, and is implemented by a cylinder 40*a* and a plunger 43. The chambers S1 and S2 are defined in the cylinder 40*a* on both sides of the plunger 43.

A human player is assumed to depress the touch button/key 15 in a direction indicated by arrow A4. The pressure sensor 23 changes the detecting signal S1 to the active level, and the controlling unit 25H notices the player fingering on the wind musical instrument 10H. The controlling unit 25H determines that the tone hole 11A is to be closed with the padded cup/padded key 14. Then, the controlling unit 25H supplies valve a control signal SH2 indicative of open state to the electromagnetic valves 45A and 48A and the valve control signal indicative of closed state to the electromagnetic valves 47A and 46A. Then, the chamber S1 is filled with the high-pressure air, and the other chamber S2 is open to the atmosphere. As a result, the plunger 43 projects from the cylinder 40*a*, and presses the padded cup/padded key 14 to the tone hole chimney 11B. The tone is produced at the new pitch. While the player is keeping the key depressed, the controlling unit 25H makes all the electromagnetic valves 45A, 46A, 47A and 48A closed so that the pneumatic actuator 40 keeps the plunger 43 pressing the padded cup/padded key 14 to the tone home chimney 11B.

When the human player releases the touch button/key 15, the pressure sensor 23 changes the detecting signal S1 to the inactive level, and the controlling unit 25H makes the electromagnetic valves 47A and 46A opened and the other electromagnetic valves 45A and 48A closed. The plunger 43 is retracted into the cylinder 40*a*, and permits the return spring (not shown) to leave the padded cup/padded key 14 from the tone hole chimney 11B. The tone is produced at the previous pitch. The controlling unit 25H keeps all the electromagnetic valves 45A, 46A, 47A and 48A closed.

Thus, the supporting system 24H achieves all the advantages of the supporting system 24.

Tenth Embodiment

Figure 14A:
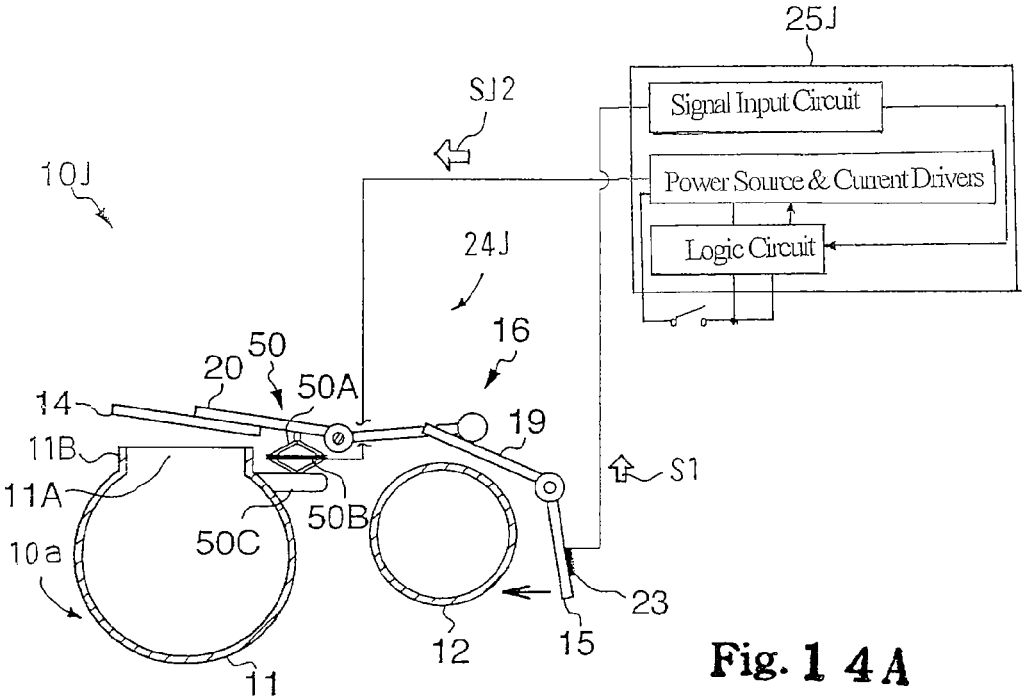
FIG. 14A is a schematic cross sectional view showing the structure of a key mechanism and an actuator incorporated in still another wind musical instrument.
Figure 14B:
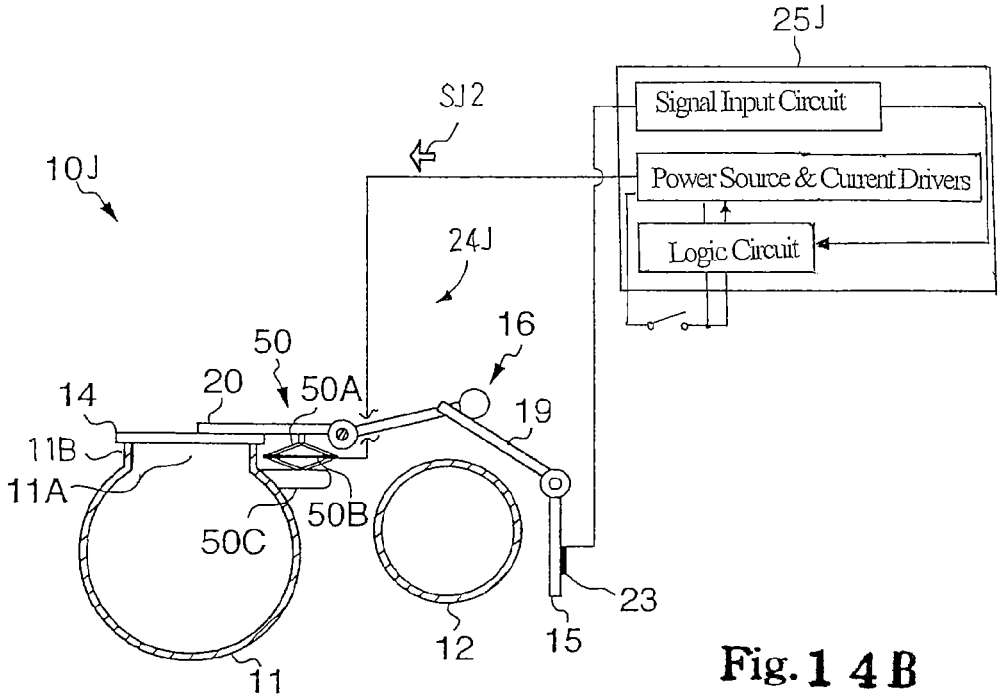
FIG. 14B is a schematic view showing a tone hole closed with a padded cup/padded key of the key mechanism.

Turning to FIGS. 14A and 14B of the drawings, still another wind musical instrument embodying the present invention also largely comprises an acoustic wind musical instrument 10J and a supporting system 24J. The acoustic wind musical instrument 10J is similar to the saxophone 10, and component parts of acoustic wind musical instrument 10J are labeled with references designating the corresponding component parts of saxophone 10 without detailed description for the sake of simplicity.

The supporting system 24J is similar to the supporting system 24 except for actuators 50. For this reason, description is focused on the actuators, and no further description on the other system components is hereinafter incorporated for avoiding repetition.

Each of the actuators 50 is provided in association with one of the touch buttons/keys 15, and is implemented by a combination of a pantograph 50A and a sheet of EAP (Electric Actuating Polymer). The sheet of EAP is used as the polymer actuator 50B, and is connected at both ends to the joints between the upper links and the lower links of the pantograph 50A. The polymer actuator 50B is connected to a bracket 50C, which in turn is connected to the tubular body 10*a*.

When a human player depresses the touch button/key 15, the pressure sensor 23 changes the detecting signal S1 to the active level, and the controlling unit 25H supplies a driving signal SJ2 indicative of elongation to the polymer actuator 50B. With the driving signal SJ2, the sheet of EAP is elongated, and makes the pantograph 50A pull the link sub-work 20. As a result, the padded cup/padded key 14 is brought into contact with the tone hole chimney 11B so that the tone hole 11A is closed with the padded cup/padded key 14 as shown in FIG. 14B.

On the other hand, when the player releases the touch button/key 15, the pressure sensor S1 is decayed to the inactive level S1, and controlling unit 25J supplies the driving signal indicative of the shrinkage to the polymer actuator 50B. The sheet of EAP is shrunk, and the pantograph 50A pushes the padded cup/padded key 14. As a result, the padded cup/padded key 14 leaves the tone hole chimney 11B, and, accordingly, the tone hole 11A is opened.

Thus, the supporting system 24J achieves all the advantages of the supporting system 24.

Eleventh Embodiment

Figure 15A:
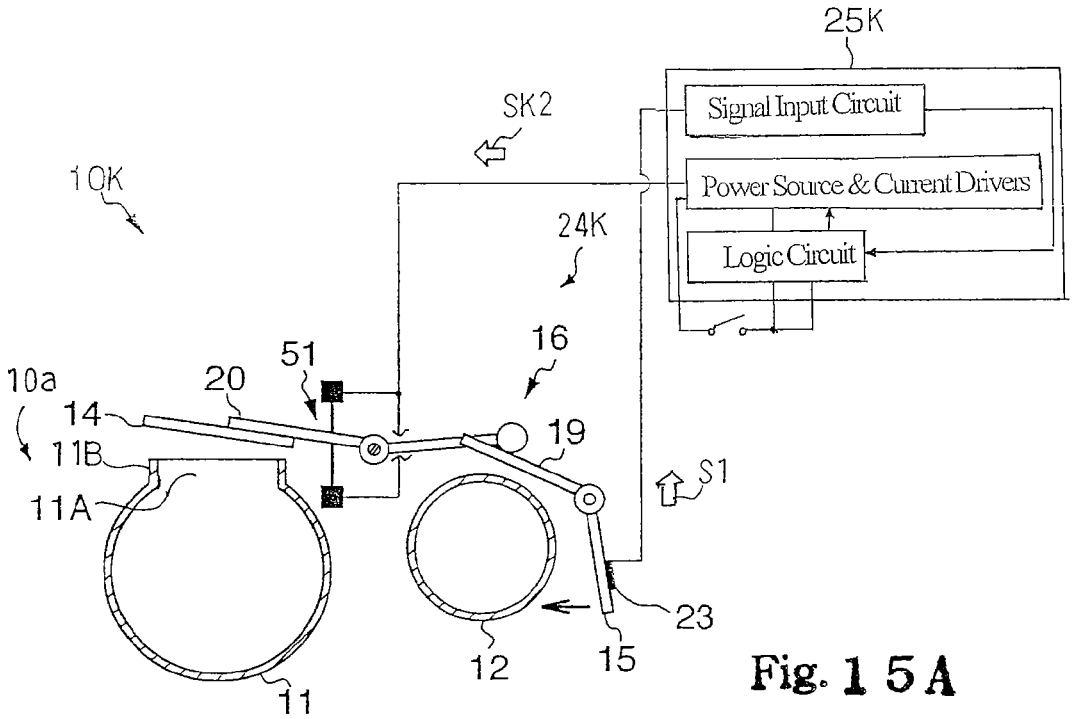
FIG. 15A is a schematic cross sectional view showing the structure of a key mechanism and an actuator incorporated in yet another wind musical instrument.
Figure 15B:
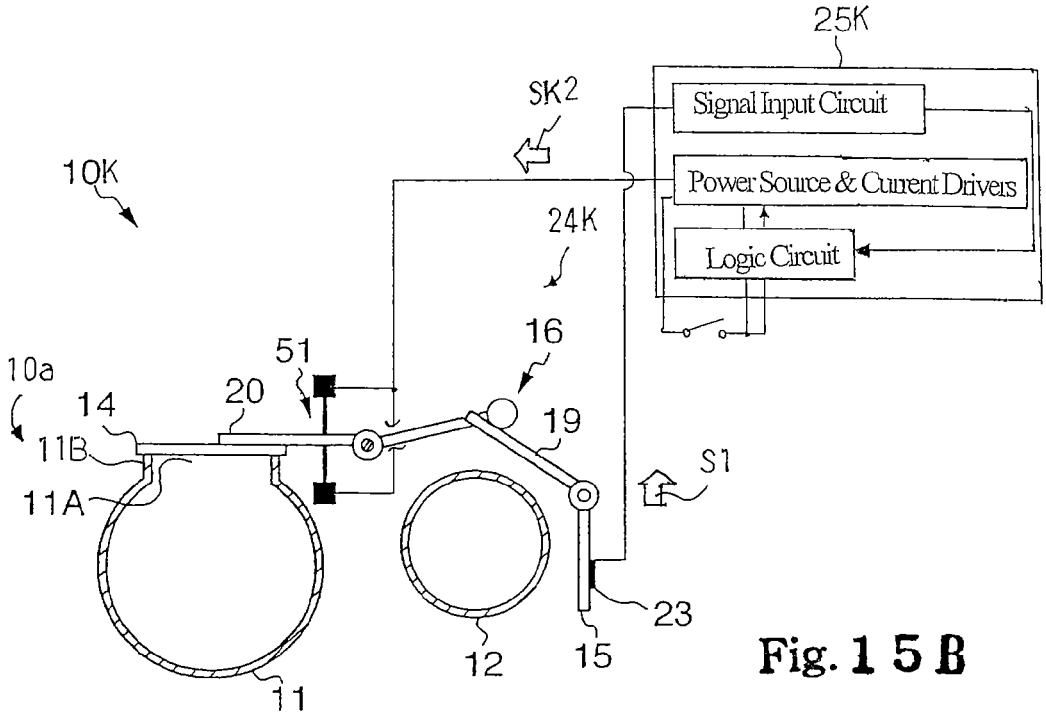
FIG. 15B is a schematic view showing a tone hole closed with a padded cup/padded key of the key mechanism.

Turning to FIGS. 15A and 15B of the drawings, yet another wind musical instrument embodying the present invention also largely comprises an acoustic wind musical instrument 10K and a supporting system 24K. The acoustic wind musical instrument 10K is similar to the saxophone 10, and component parts of acoustic wind musical instrument 10K are labeled with references designating the corresponding component parts of saxophone 10 without detailed description for the sake of simplicity.

The supporting system 24K is similar to the supporting system 24 except for actuators 51. For this reason, description is focused on the actuators, and no further description on the other system components is hereinafter incorporated for avoiding repetition.

Each of the actuators 51 is provided in association with one of the touch buttons/keys 15, and is implemented by a pair of pieces of shape memory alloy 51. The pieces of shape memory alloy 51 are connected at certain ends thereof to both of the upper and lower portions of the link sub-work 20, respectively and at the other end thereof to suitable brackets connected to the tubular body 10*a*, and the controlling unit 25K supplies a driving signal SK2 to the pieces of shape memory alloy 51.

When a human player depresses the touch button/key 15, the pressure sensor 23 changes the detecting signal S1 to the active level, and the controlling unit 25K supplies a driving signal SK2 indicative of a new shape to the pieces of shape memory alloy 51. With the driving signal SK2, the pieces of shape memory alloy 51 press the padded cup/padded key 14, and the padded cup/padded key 14 is brought into contact with the tone hole chimney 11B so that the tone hole 11A is closed with the padded cup/padded key 14 as shown in FIG. 15B.

On the other hand, when the player releases the touch button/key 15, the pressure sensor S1 is decayed to the inactive level, and controlling unit 25K supplies the driving signal SK2 indicative of the previous shape to the pieces of shape memory alloy 51. The pieces of shape memory alloy 51 permit the padded cup/padded key 14 to leave the tone hole chimney 11B. As a result, the tone hole 11A is opened.

Thus, the supporting system 24K achieves all the advantages of the supporting system 24.

Twelfth Embodiment

Figure 16A:
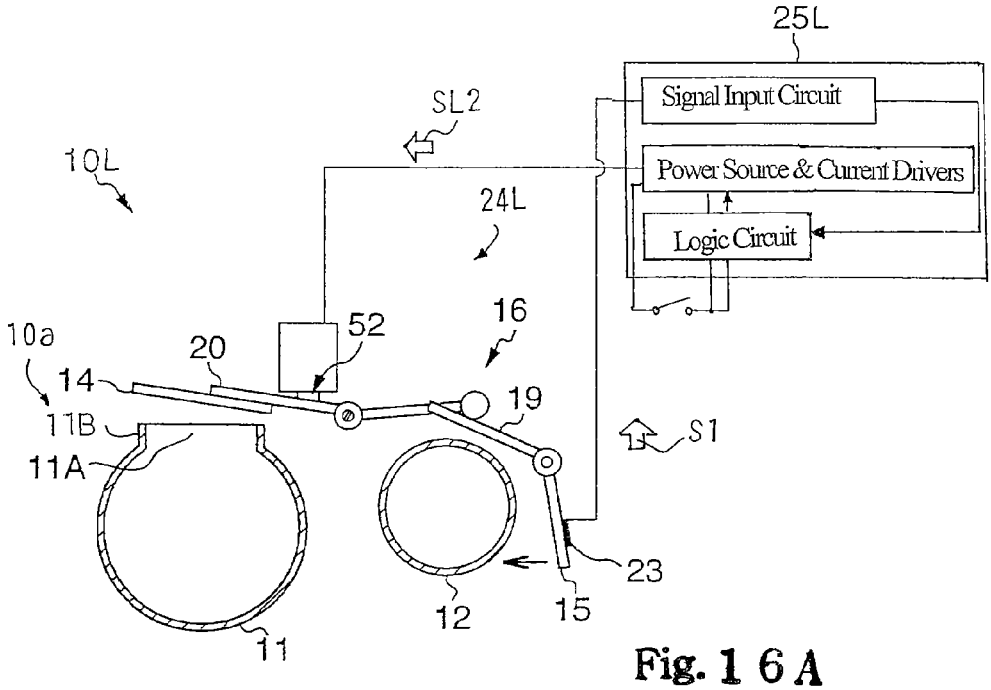
FIG. 16A is a schematic cross sectional view showing the structure of a key mechanism and an actuator incorporated in still another wind musical instrument.
Figure 16B:
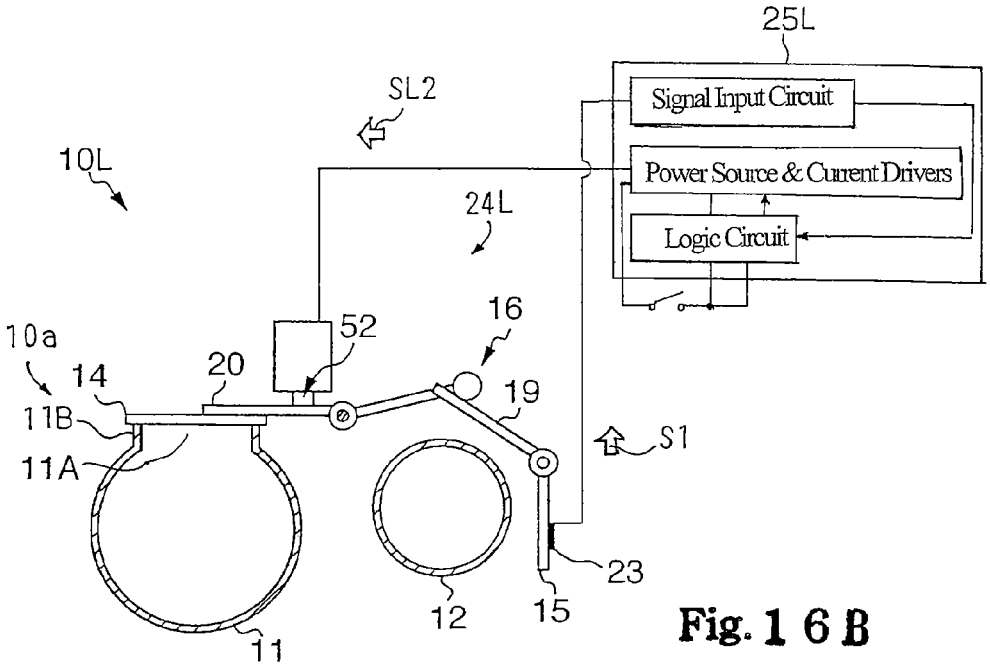
FIG. 16B is a schematic view showing a tone hole closed with a padded cup/padded key of the key mechanism.

Turning to FIGS. 16A and 16B of the drawings, still another wind musical instrument embodying the present invention also largely comprises an acoustic wind musical instrument 10L and a supporting system 24L. The acoustic wind musical instrument 10L is similar to the saxophone 10, and component parts of acoustic wind musical instrument 10L are labeled with references designating the corresponding component parts of saxophone 10 without detailed description for the sake of simplicity.

The supporting system 24L is similar to the supporting system 24 except for actuators 52. For this reason, description is focused on the actuators 52, and no further description on the other system components is hereinafter incorporated for avoiding repetition.

Each of the actuators 52 is provided in association with one of the touch buttons/keys 15, and is implemented by a bimorph piezoelectric element 52. The bimorph piezoelectric element 52 is connected at one end thereof to the link sub-work 20 and at the other end thereof to a suitable bracket (not shown) connected to the tubular body 10*a*, and the controlling unit 25L supplies a driving signal SL2 to the bimorph piezoelectric element 52.

When a human player depresses the touch button/key 15, the pressure sensor 23 changes the detecting signal S1 to the active level, and the controlling unit 25K supplies a driving signal SL2 indicative of bend to the bimorph piezoelectric element 52. With the driving signal SL2, the bimorph piezoelectric element 52 presses the padded cup/padded key 14 to the tone hole chimney 11B, and the padded cup/padded key 14 is brought into contact with the tone hole chimney 11B so that the tone hole 11A is closed with the padded cup/padded key 14 as shown in FIG. 16B.

On the other hand, when the player releases the touch button/key 15, the pressure sensor S1 is decayed to the inactive level, and controlling unit 25L supplies the driving signal SL2 indicative of the recovery to the bimorph piezoelectric element 52. The bimorph piezoelectric element 52 permits the padded cup/padded key 14 to leave the tone hole chimney 11B. As a result, the tone hole 11A is opened.

Thus, the supporting system 24L achieves all the advantages of the supporting system 24.

Thirteenth Embodiment

Figure 17:
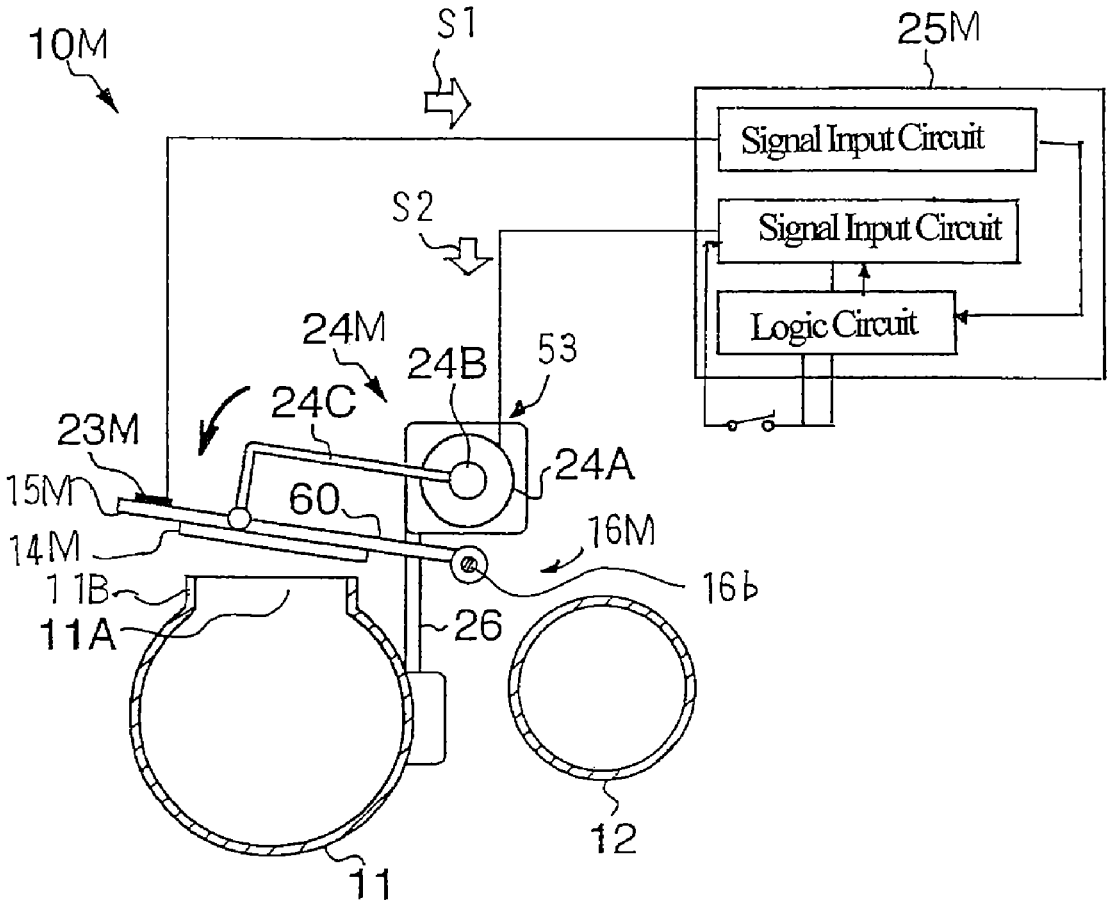
FIG. 17 is a schematic cross sectional view showing the structure of a key mechanism and an actuator incorporated in yet another wind musical instrument.

Turning to FIG. 17 of the drawings, yet another wind musical instrument embodying the present invention. The wind musical instrument largely comprises an acoustic wind musical instrument 10M and a supporting system 24M. The acoustic wind musical instrument 10M is similar to the saxophone 10 except for a key mechanism 16M, and the other component parts of acoustic wind musical instrument 10M are labeled with references designating the corresponding component parts of saxophone 10 without detailed description for the sake of simplicity.

Any link sub-work is not incorporated in the key mechanism 16M. Levers 15M are layered on predetermined padded cups 14M, and are rotatably supported by shafts 16*b*. For this reason, a human player changes the pitch of tones by depressing and releasing the levers 15M.

The supporting system 24M includes sensors 23M, actuators 53 and a controlling unit 25M. The sensors 23M are same as the pressure-sensitive pads 23, and are adhered to the upper surfaces of the levers 15M, respectively. When the human player depresses the levers 15M, the force is exerted on the sensors 23M, and the depressed sensors 23M change the potential level of the detecting signals S1. The actuators 53 are provided for all the padded cups 14M, respectively, and each of the actuators 53 is implemented by the combination of ultrasonic motor 24A with output shaft 24B and arm 24C.

When the human player fingers on the levers 15M, the controlling unit 25M determines the tone holes 11A to be closed with the padded cups 14M, and supplies the driving signals S2 to the actuators 53 associated with the padded cups 14M. With the driving signals S2, the actuators 53 give rise to the rotation of the padded cups 14M so that the tone holes 11A are closed with the padded cups 14M.

As will be appreciated from the foregoing description, the supporting systems 24, 24A, 24B, 24C, 24D, 24E, 24F, 24G, 24H, 24J, 24K, 24L and 24M assist the human players in fingering on the key mechanisms 16 and 16M so that the human players easily play music tunes on the acoustic wind musical instruments 10, 10A, 10B, 10C, 10D, 10E, 10F, 10G, 10H, 10J, 10K, 10L and 10M.

Although particular embodiments of the present invention have been shown and described, it will be apparent to those skilled in the art that various changes and modifications may be made without departing from the spirit and scope of the present invention.

Figure 18A:
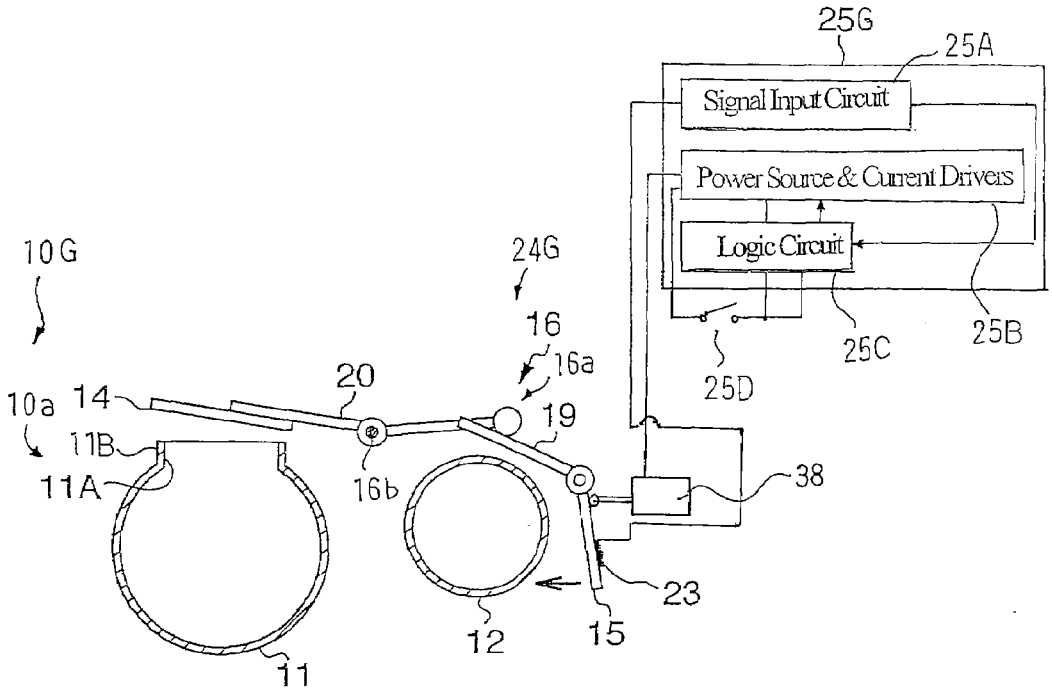
FIG. 18A is a schematic cross sectional view showing the structure of a key mechanism and an actuator incorporated in a modification of the wind musical instrument shown in FIGS. 12A and 12B.
Figure 18B:
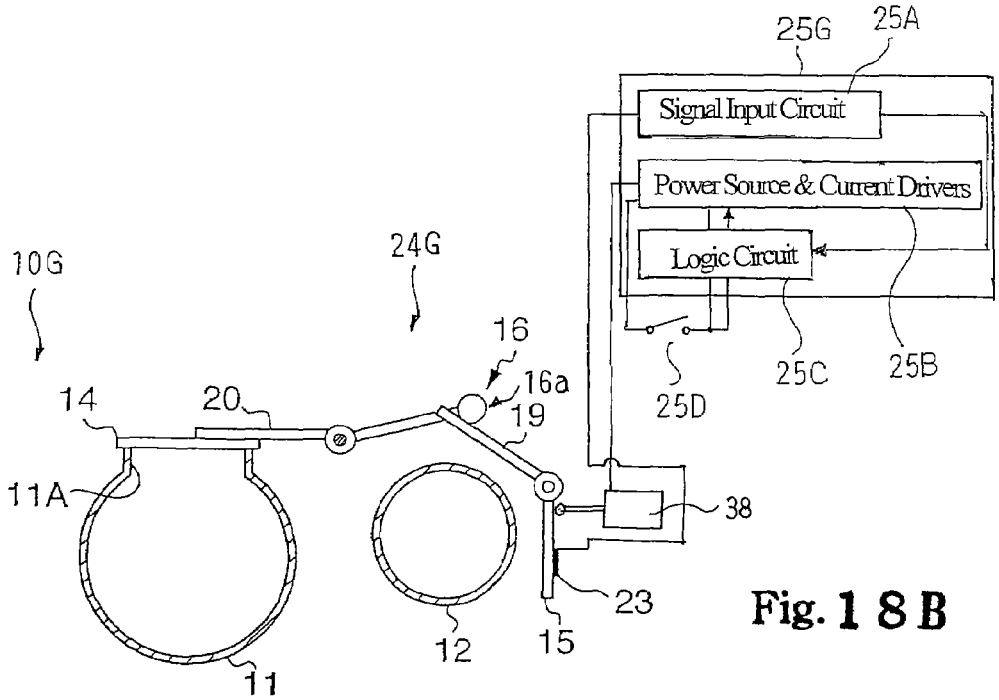
FIG. 18B is a schematic view showing a tone hole closed with a padded cup/padded key of the key mechanism.
Figure 19A:
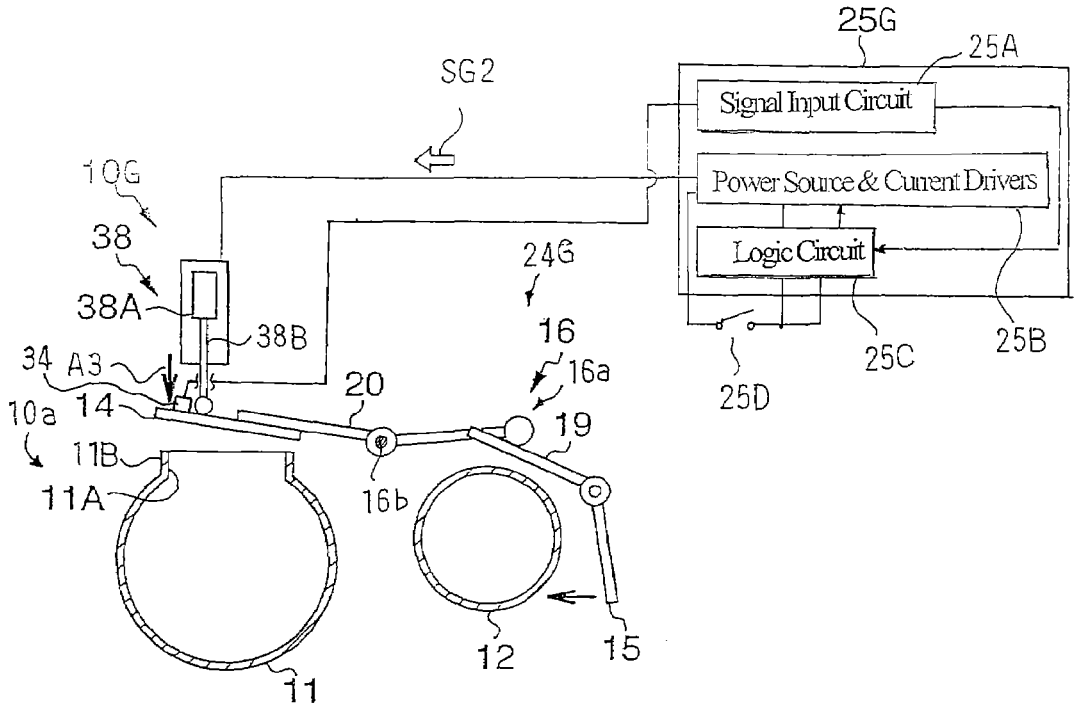
FIG. 19A is a schematic cross sectional view showing the structure of a key mechanism and an actuator incorporated in another modification of the wind musical instrument shown in FIGS. 12A and 12B.
Figure 19B:
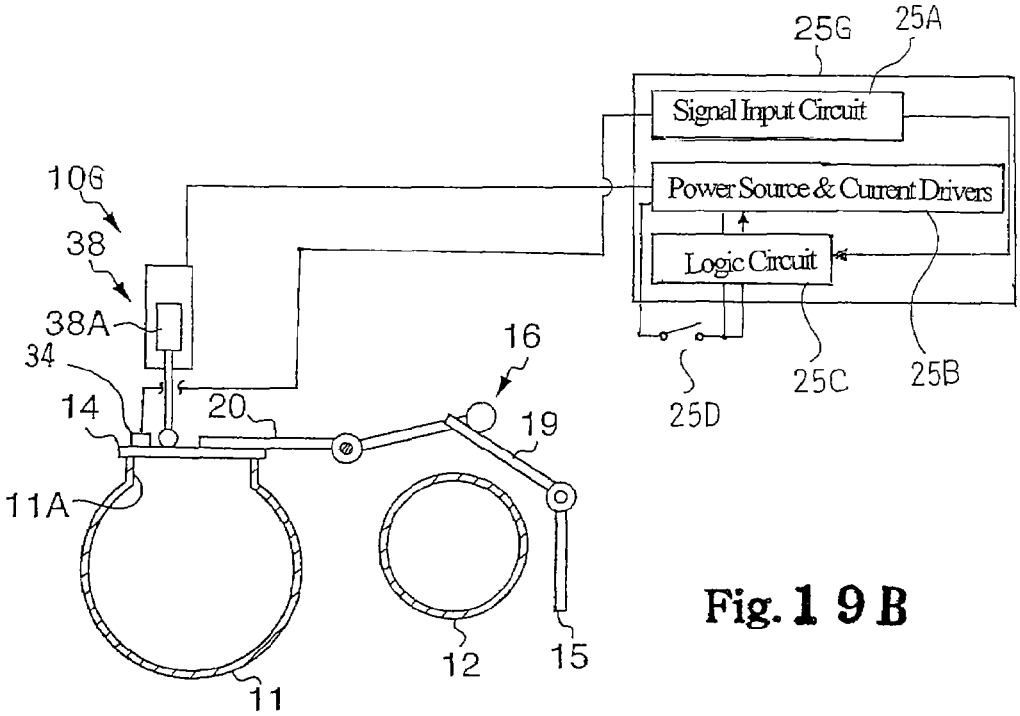
FIG. 19B is a schematic view showing a tone hole closed with a padded cup/padded key of the key mechanism.

The force may be exerted on the touch buttons/keys 15 as shown in FIGS. 18A and 18B, and the padded cups/padded keys 14 may be monitored with the sensors such as, for example, acceleration sensors 34 as shown in FIGS. 19A and 19B. Thus, the locations of sensors and actuators do not set any limit to the technical scope of the present invention.

The battery may be replaced with a transformer connectable to a wall outlet through a cable.

The controlling unit 25 may be physically separated from the saxophone 10. In this instance, the sensors 23 and actuators 24*a* are connected to the controlling unit 25 through cables.

The tenor saxophone does not set any limit to the technical scope of the present invention. The supporting system of the present invention may be combined with an alto saxophone, baritone saxophone, a soprano saxophone, a clarinet, an alto clarinet, a bass clarinet, an oboe, an English horn, a bassoon, a flute, a piccolo or a bass recorder, by way of example.

The controlling unit 25 may instruct the power source and current drivers 25B to cause the ultrasonic motor 24A to release the output shaft 24B from the restriction. Then, the return spring (not shown) gives rise to the rotation of link sub-work 20 in the direction opposite to the arrow A2, and the padded cup 14 returns to the rest position.

A semiconductor acceleration sensor may be fabricated on a semiconductor substrate. In detail, a weight piece and beams are formed on the semiconductor substrate. The Wheatstone bridge circuit is formed in the beams, and the acceleration is detected as the force exerted on the weight.

The pneumatic actuator system 39 may be replaced with a hydraulic actuator system.

Any one of the sensors of the second to seventh embodiments may be combined with the actuators of the eighth to twelfth embodiments, and any one of the actuators of the eighth to twelfth embodiments may be combined with the sensors of the second to seventh embodiments.

The sensors 23M may be arrayed in a control board. In this instance, the levers 15M are deleted from the key mechanism 16M.

The ultrasonic motors 24A may be replaced with a pulse motor or a direct-current motor. The electric power may be continuously supplied to the direct-current motor for keeping the padded cups/padded keys at the closed positions.

More than one sort of actuators may be incorporated in the supporting system, and more than one sort of sensors may be incorporated in the supporting system.

The component parts of the above-described embodiments are correlated with claim languages as follows.

The saxophone 10 and acoustic wind musical instruments 10, 10A, 10B, 10C, 10D, 10E, 10F, 10G, 10H, 10J, 10K, 10L and 10M are corresponding to an "acoustic wind musical instrument", and the padded cups/padded keys 14 and 14M serve as "padded closers". The pressure-sensitive pads 23, combination of pressure-sensitive pads 29 and pusher 28, combination 32 of magnetic scale 32A and magnetic sensor head 32B, combination 33 of piece of permanent magnet 33A and electromagnetic pickup unit 33B, acceleration sensor 34, strain sensor 35 and combination 36 of magnetostriction element 36A and coil 36B serve as "sensors". The combination of ultrasonic motor 24A with output shaft 24B and arm 24C, solenoid-operated actuator 38, pneumatic system 39, combination 50 of pantograph 50A and polymer motor 50B, pieces of shape memory alloy 51 and bimorph piezoelectric element 52 serve as "actuators".

The touch buttons and keys 15 and levers 15M serve as "manipulators". The link sub-works 19 and 20 as a whole constitute a "link work". The ultrasonic motor 24A, solenoid-operated actuator 38, pneumatic actuator 40, polymer motor 50B, pieces of shape memory alloys 51 and bimorph piezoelectric element 52 serve as a "driver", and the arm 24C and pantograph 50A serve as a "converter".

What is claimed is:

1. A wind musical instrument for producing tones through vibrations of air column, comprising:

an acoustic wind musical instrument including a tubular body formed with tone holes so as to vary length of said air column defined therein, and a key mechanism having padded closers responsive to fingering of a human player so as to close and open said tone holes; and a supporting system combined with said acoustic wind musical instrument, and including sensors producing detecting signals representative of said fingering, actuators provided on said tubular body in association with said padded closers and responsive to driving signals so as to cause said tone holes to be closed with said padded closers and opened and a controlling unit connected to said sensors and said actuators, determining certain tone holes to be closed with said padded closers and opened on the basis of said detecting signals and supplying said driving signals to the actuators associated with said certain tone holes.

2. The wind musical instrument as set forth in claim 1, in which said key mechanism further includes manipulators moved by said human player.

3. The wind musical instrument as set forth in claim 2, in which said manipulators are monitored with said sensors.

4. The wind musical instrument as set forth in claim 2, in which a link mechanism is provided between said manipulators and said padded closers so as to propagate the force exerted on said manipulators to said padded closers.

5. The wind musical instrument as set forth in claim 4, in which said manipulators are monitored with said sensors, and said human player exerts force on said padded closers by means of said actuators.

6. The wind musical instrument as set forth in claim 2, in which said human player exerts force on said manipulators by means of said actuators.

7. The wind musical instrument as set forth in claim 1, in which said supporting system is activated by said human player so as to assist said human player in said fingering, and said human player performs a music passage without any assistance of said supporting system deactivated by said human player.

8. The wind musical instrument as set forth in claim 1, in which said sensors produces said detecting signal representative of a physical quantity selected from the group consisting of force, position, velocity, acceleration, strain and torque.

9. The wind musical instrument as set forth in claim 1, in which each of said actuators includes a driver responsive to said driving signal so as to convert the electric power of said driving signal to force exerted on associated one of said padded closers.

10. The wind musical instrument as set forth in claim 9, in which said each of said actuators further includes a converter converting the movement of an output part of said driver to movements of said associated one of said padded closers.

11. The wind musical instrument as set forth in claim 1, in which said acoustic wind musical instrument is selected from the group consisting of a tenor saxophone, an alto saxophone, a baritone saxophone, a soprano saxophone, clarinet, an alto clarinet, a bass clarinet, an oboe, an English horn, a bassoon, a flute, a piccolo and a bass recorder.

12. A supporting system combined with an acoustic wind musical instrument having a tubular body formed with tone holes and a key mechanism used for closing and opening said tone holes, comprising:

sensors producing detecting signals representative of fingering of a human player on said key mechanism;

actuators provided on said tubular body in association with padded closers of said key mechanism, and responsive to driving signals so as to cause said tone holes to be closed with said padded closers and opened; and a controlling unit connected to said sensors and said actuators, determining certain tone holes to be closed with said padded closers and opened on the basis of said detecting signals, and supplying said driving signals to the actuators associated with said certain tone holes.

13. The supporting system as set forth in claim 12, in which said key mechanism further includes manipulators moved by said human player.

14. The supporting system as set forth in claim 13, in which said manipulators are monitored with said sensors.

15. The supporting system as set forth in claim 13, in which a link mechanism is provided between said manipulators and said padded closers so as to propagate the force exerted on said manipulators to said padded closers.

16. The supporting system as set forth in claim 15, in which said manipulators are monitored with said sensors, and said human player exerts force on said padded closers by means of said actuators.

17. The supporting system as set forth in claim 13, in which said human player exerts force on said manipulators by means of said actuators.

18. The supporting system as set forth in claim 12, in which said supporting system is activated by said human player so as to assist said human player in said fingering, and said human player performs a music passage without any assistance of said supporting system deactivated by said human player.

19. The supporting system as set forth in claim 12, in which said sensors produces said detecting signal representative of a physical quantity selected from the group consisting of force, position, velocity, acceleration, strain and torque.

20. The supporting system as set forth in claim 12, in which each of said actuators includes a driver responsive to said driving signal so as to convert the electric power of said driving signal to force exerted on associated one of said padded closers, and a converter converting the movement of an output part of said driver to movements of said associated one of said padded closers.

* * * * *